US009195211B2

(12) United States Patent
Mori

(10) Patent No.: US 9,195,211 B2
(45) Date of Patent: Nov. 24, 2015

(54) PROCESS CARTRIDGE HAVING A LINK MEMBER, ELECTROPHOTOGRAPHIC IMAGE FORMING APPARATUS HAVING A LINK MEMBER, AND ASSEMBLY METHOD OF PROCESS CARTRIDGE HAVING A LINK MEMBER

(75) Inventor: Tomonori Mori, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 13/495,171

(22) Filed: Jun. 13, 2012

(65) Prior Publication Data

US 2012/0321342 A1 Dec. 20, 2012

(30) Foreign Application Priority Data

Jun. 17, 2011 (JP) ..... 2011-135098
May 8, 2012 (JP) ..... 2012-106922

(51) Int. Cl.
*G03G 21/16* (2006.01)
*G03G 21/18* (2006.01)

(52) U.S. Cl.
CPC ..... *G03G 21/1825* (2013.01)

(58) Field of Classification Search
CPC ..... G03G 21/1825
USPC ..... 399/111, 112, 113, 114
See application file for complete search history.

(56) References Cited

U.S. PATENT DOCUMENTS

2010/0189466 A1* 7/2010 Otani ..... 399/167
2012/0177400 A1* 7/2012 Jang et al. ..... 399/111

FOREIGN PATENT DOCUMENTS

EP 740227 A1 10/1996
EP 757304 A2 2/1997
JP 8-339149 A 12/1996
JP 2007133180 A * 5/2007

* cited by examiner

*Primary Examiner* — Billy Lactaoen
(74) *Attorney, Agent, or Firm* — Canon U.S.A., Inc. IP Division

(57) ABSTRACT

A process cartridge configured to be removably mounted on an apparatus body of an electrophotographic image forming apparatus includes a photosensitive unit including a photosensitive drum; a developing unit including a developing roller configured to develop an electrostatic latent image formed on the photosensitive drum, and configured to be rotatably coupled with the photosensitive unit around only a single center of rotation at one end side of the process cartridge in an axial direction of the photosensitive drum; and a link member provided at the other end side of the process cartridge in the axial direction, and configured to be rotatably coupled with the photosensitive unit and the developing unit and promote relative movement between the developing roller and the photosensitive drum.

31 Claims, 30 Drawing Sheets

PROCESS CARTRIDGE HAVING A LINK MEMBER, ELECTROPHOTOGRAPHIC IMAGE FORMING APPARATUS HAVING A LINK MEMBER, AND ASSEMBLY METHOD OF PROCESS CARTRIDGE HAVING A LINK MEMBER

BACKGROUND OF THE INVENTION

1. Field of the Invention

The present disclosure relates to a process cartridge, an electrophotographic image forming apparatus using the process cartridge, and an assembly method of the process cartridge.

The electrophotographic image forming apparatus forms an image on a recording medium by using an electrophotographic image forming system. The electrophotographic image forming apparatus may be, for example, an electrophotographic copier, a laser beam printer, a LED printer, or a facsimile apparatus.

The process cartridge has a cartridge, in which an electrophotographic photosensitive member and a process unit that acts on the electrophotographic photosensitive member are integrated, and which is removably mounted on an apparatus body of the electrophotographic image forming apparatus.

2. Description of the Related Art

There has been typically known a process cartridge in which a developing unit including a developing roller as a developing device is rotatably coupled with a photosensitive unit including a photosensitive drum as an electrophotographic photosensitive member by a coupling member. In this process cartridge, the developing unit is urged to the photosensitive unit by the weight of the developing unit or an urging member such as a spring. Hence, the developing roller in the developing unit can be stably urged to the photosensitive drum in the photosensitive unit. A developing system used in the electrophotographic image forming apparatus includes a non-contact developing system in which a very small gap is provided between the surface of the developing roller and the surface of the photosensitive drum. In the non-contact developing system, gap retaining members are provided at both ends of the developing roller, and the developing roller comes into contact with the photosensitive drum through the gap retaining members. Since the gap retaining members retain a constant gap between the surface of the developing roller and the surface of the photosensitive drum, the electrophotographic image forming apparatus can stably output a good image.

However, alignment between the rotation axis of the developing roller and the rotation axis of the photosensitive drum may be deviated from an intended relationship, for example, because the dimensions or assembly positions of respective members used for the process cartridge have errors or an impact is applied to the process cartridge and hence the process cartridge is deformed. At this time, a contact pressure of the developing roller with respect to the photosensitive drum at one end in an axial direction of the developing roller may be markedly smaller than a contact pressure of the developing roller at the other end, and the one end side of the developing roller may be separated from the photosensitive drum (hereinafter, referred to as one-side contact). To correct the one-side contact of the developing roller, a large urging force has to be applied to the one end side of the developing roller.

There is known the following method as a method of stably urging the developing roller to the photosensitive drum.

Japanese Patent Laid-Open No. 8-339149 describes a method of fitting a shaft that rotatably couples the developing unit with the photosensitive unit to a long hole at the one end side in the longitudinal direction of the process cartridge. If a gap is generated between the shaft and the long hole, the coupling position of the developing unit and the photosensitive unit can be moved. This movement absorbs the errors of the dimensions of the respective members of the process cartridge. Hence the developing roller is stably urged to the photosensitive drum.

SUMMARY OF THE INVENTION

The present disclosure improves the above-described configuration and makes the urging force of a developing roller to a photosensitive drum stable.

Also, the present disclosure provides a process cartridge configured to be removably mounted on an apparatus body of an electrophotographic image forming apparatus and including a photosensitive unit including a photosensitive drum; a developing unit including a developing roller configured to develop an electrostatic latent image formed on the photosensitive drum, and configured to be rotatably coupled with the photosensitive unit around only a single center of rotation at one end side of the process cartridge in an axial direction of the photosensitive drum; and a link member provided at the other end side of the process cartridge in the axial direction, and configured to be rotatably coupled with the photosensitive unit and the developing unit and promote relative movement between the developing roller and the photosensitive drum.

Further, the present disclosure provides an electrophotographic image forming apparatus configured to form an image on a recording medium, the electrophotographic image forming apparatus including (i) a process cartridge configured to be removably mounted on an apparatus body of an electrophotographic image forming apparatus and including a photosensitive unit including a photosensitive drum, a developing unit including a developing roller configured to develop an electrostatic latent image formed on the photosensitive drum, and configured to be rotatably coupled with the photosensitive unit around only a single center of rotation at one end side of the process cartridge in an axial direction of the photosensitive drum, and a link member provided at the other end side of the process cartridge in the axial direction, and configured to be rotatably coupled with the photosensitive unit and the developing unit and promote relative movement between the developing roller and the photosensitive drum; and (ii) a conveying unit configured to convey the recording medium.

Further, the present disclosure provides an assembly method of a process cartridge including a photosensitive unit having a photosensitive drum on which an electrostatic latent image is formed, and a developing unit having a developing roller configured to support a developer for developing the electrostatic latent image, the method including rotatably attaching a link member to one end side of the developing unit in an axial direction of the developing roller; rotatably attaching the link member to one end side of the photosensitive unit in an axial direction of the photosensitive drum; and coupling the other end side of the developing unit in the axial direction of the developing roller with the other end side of the photosensitive unit in the axial direction of the photosensitive drum rotatably around only a single center of rotation.

Further features will become apparent from the following description of exemplary embodiments with reference to the attached drawings.

DESCRIPTION OF THE EMBODIMENTS

First Embodiment

Next, a process cartridge and an electrophotographic image forming apparatus, on which the process cartridge can be removably mounted, according to an embodiment of the disclosure are described with reference to the drawings.

Overview of Electrophotographic Image Forming Apparatus

Figure 1:
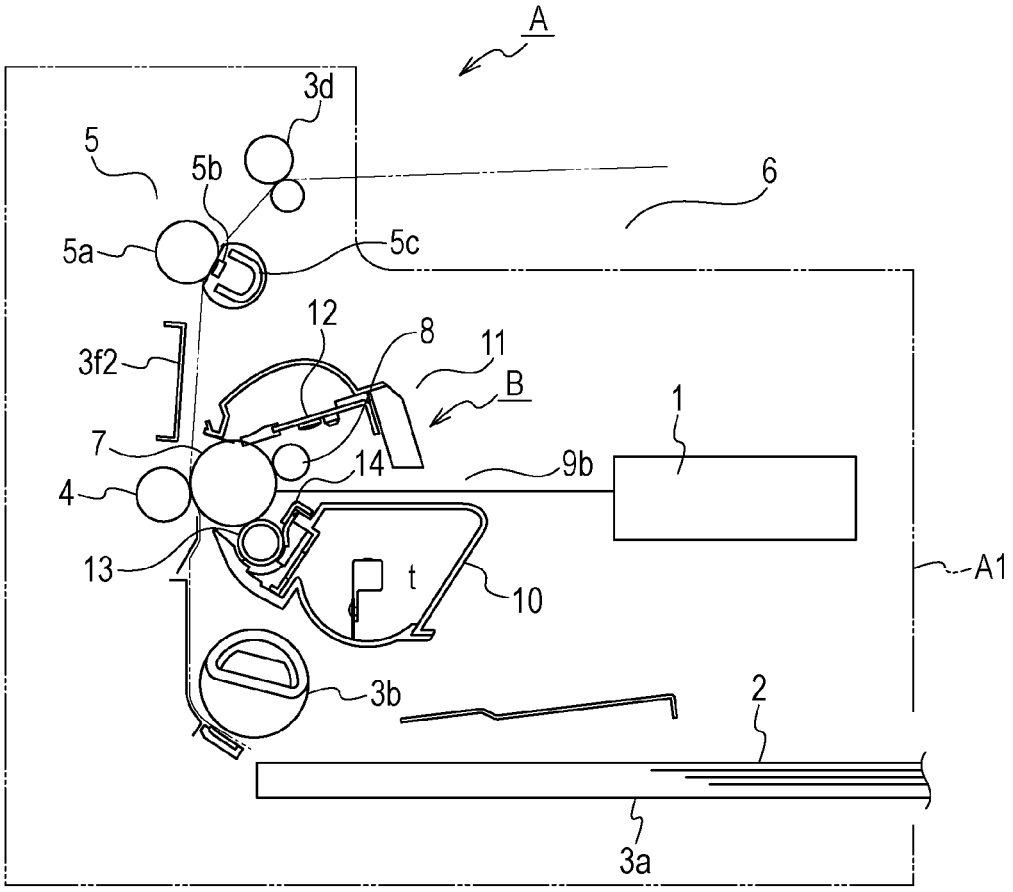
FIG. 1 is a side sectional view showing the general configuration of an image-forming apparatus.
Figure 2:
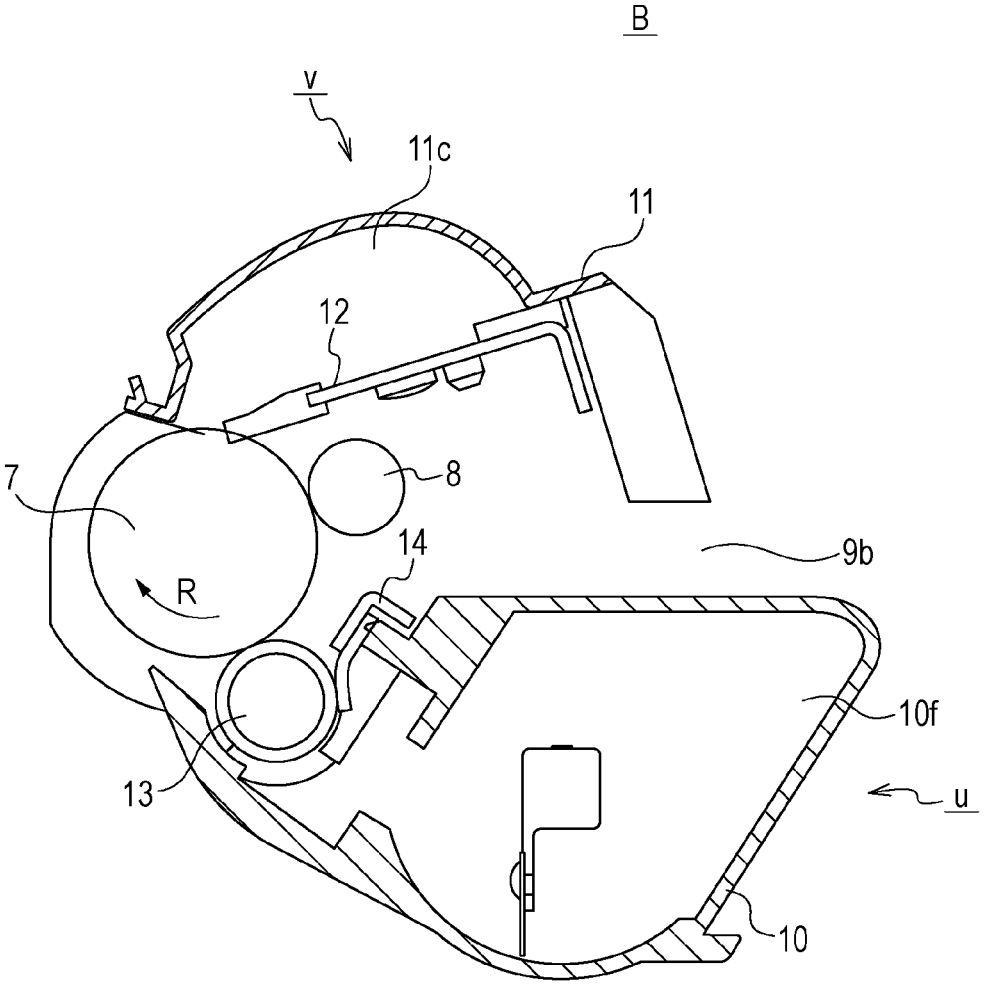
FIG. 2 is a side sectional view showing the general configuration of a process cartridge.

First, the general configuration of an electrophotographic image forming apparatus A is described with reference to FIGS. 1 and 2. FIG. 1 is a side sectional view showing a state in which the process cartridge of this embodiment is mounted on an apparatus body A1 of the electrophotographic image forming apparatus A. FIG. 2 is a side sectional view showing the process cartridge to which this embodiment can be applied. The apparatus body A1 is a portion obtained when a process cartridge B is removed from the electrophotographic image forming apparatus A.

Image formation by the electrophotographic image forming apparatus A according to this embodiment is described. As shown in FIG. 1, an electrophotographic photosensitive member (hereinafter, referred to as "photosensitive drum") 7 having a drum-like shape and containing a photosensitive layer is irradiated with a laser-light image from an optical system 1 in accordance with image information. Hence, an electrostatic latent image is formed on the photosensitive drum 7. When a voltage is applied to a developing roller 13 serving as a developer holding member that holds a developer t, the developer t moves from the developing roller 13 to the photosensitive drum 7. Accordingly, an image with the toner t is formed on the photosensitive drum 7. A sheet 2 serving as a recording medium is conveyed from a cassette 3*a* by a conveying unit 3*b* in synchronization with formation of the developer image. When a voltage is applied to a transfer roller 4 serving as a transfer unit, the developer image formed on the photosensitive drum 7 is transferred on the sheet 2 in an image forming unit provided in a form of a cartridge as the process cartridge B. Then, the sheet 2 is conveyed to a fixing unit 5 while being guided by a guide plate 3*f*2. The fixing unit 5 includes a driving roller 5*a* and a fixing roller 5*c* containing a heater 5*b*. The sheet 2, which has passed through the fixing unit 5, is conveyed by a pair of output rollers 3*d*, passes through a reverse conveyance path, and is output to an output portion 6.

Configuration of Process Cartridge

The process cartridge B according to this embodiment includes the photosensitive drum 7 and the developing roller 13 that develops an electrostatic latent image formed on the photosensitive drum 7. The photosensitive drum 7 and the developing roller 13 are integrated in the form of a cartridge.

As shown in FIG. 2, when an image is formed by using the process cartridge B of this embodiment, the photosensitive drum 7 is rotated in a direction indicated by arrow R. Then, the surface of the photosensitive drum 7 is uniformly electrified by an electrifying roller 8 serving as an electrifying unit. The light emitted from the optical system 1 passes through an exposure opening 9*b* of a cleaning frame member 11 and exposes the peripheral surface of the photosensitive drum 7. Hence, an electrostatic latent image is formed on the photosensitive drum 7. Also, a development container 10 is provided with a development blade 14 serving as a developer regulating member, and the developing roller 13 serving as the developer holding member. The development container 10 has a developer housing portion 10*f* that houses the developer t for supply to the developing roller 13. The development blade 14 is in contact with the developing roller 13 with a predetermined pressing force and regulates the developer t on the developing roller 13. Hence a uniform developer layer is formed on the developing roller 13. Then a development bias is applied to the developing roller 13, so that the developer t is transferred onto the photosensitive drum 7 in accordance with the latent image. Accordingly, the developer image is formed on the photosensitive drum 7 in accordance with the latent image. When a transfer bias is applied to the transfer roller 4, the developer image is transferred on the sheet 2. The developer t remaining on the photosensitive drum 7 after the developer image is transferred on the sheet 2 is removed by a cleaning blade 12 serving as a cleaning unit. The removed developer t is collected in a removed developer housing portion 11*c*.

The process cartridge B includes a photosensitive unit v and a developing unit u. The photosensitive unit v has the cleaning frame member 11 serving as a frame member (a first frame member) that supports respective members included in the photosensitive unit v, and also has the electrifying roller 8 and the cleaning blade 12. The developing unit u has the development container 10 serving as a frame member (a second frame member) that supports respective members included in the developing unit u, and also has the developing roller 13 and the development blade 14.

Figure 3B:
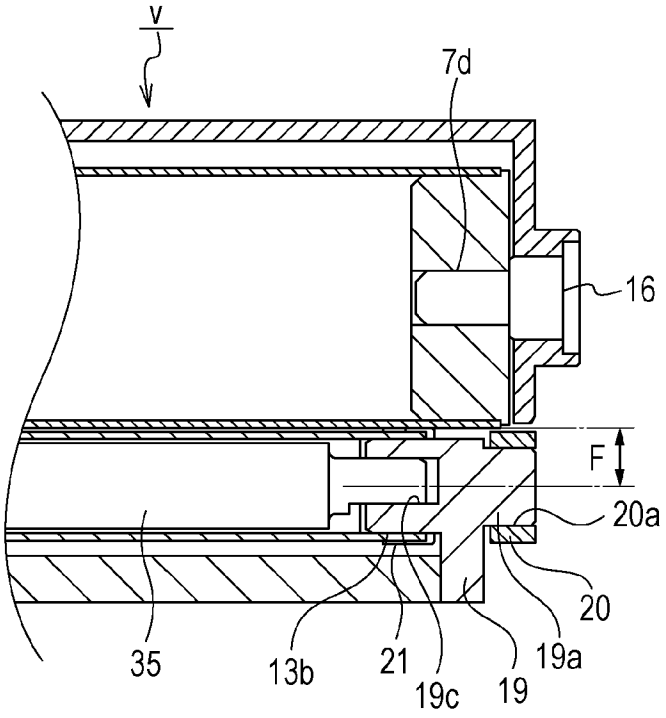
FIGS. 3A and 3B are cross-sectional views in the longitudinal direction of the process cartridge.
Figure 3A:
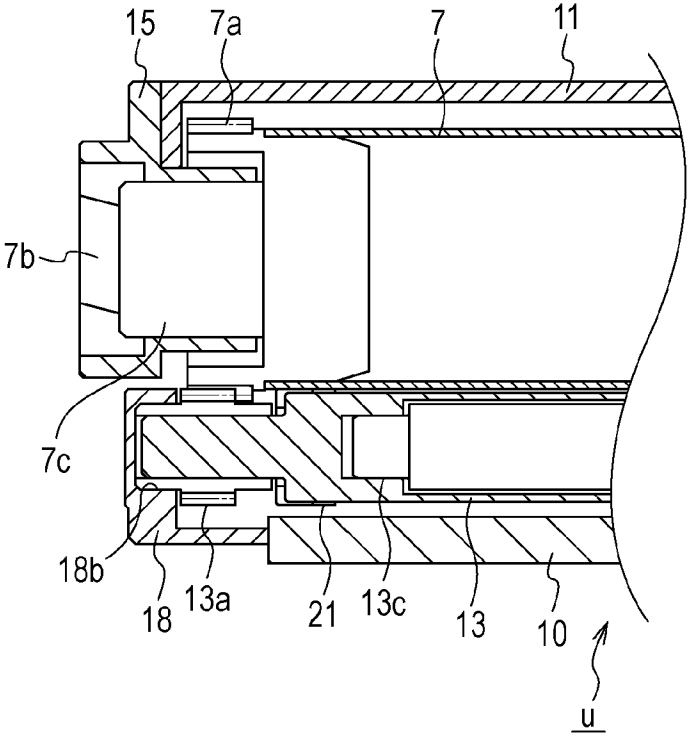

Next, supporting and driving methods of the photosensitive drum 7 and the developing roller 13 are described with reference to cross-sectional views of the process cartridge B in FIGS. 3A and 3B. FIG. 3A illustrates one end side in the longitudinal direction of the process cartridge B, and FIG. 3B illustrates the other end side. It is to be noted that the longitudinal direction of the process cartridge in this embodiment is the same direction as the axial direction of the photosensitive drum 7. The photosensitive drum 7 and the developing roller 13 are arranged in substantially parallel to each other. Hence the longitudinal direction of the process cartridge is substantially aligned with the axial direction of the developing roller 13. Also in the following description, if the longitudinal direction of the process cartridge is mentioned, this direction indicates the same direction as the axial direction of the photosensitive drum 7 as mentioned above.

The photosensitive drum 7 has a shaft 7*c* and a hole 7*d* respectively at both end sides. The shaft 7*c* is rotatably supported by a drum bearing member 15. The hole 7*d* is rotatably supported by a drum shaft 16. The drum bearing member 15 and the drum shaft 16 are fixed to the cleaning frame member 11, and form the frame member (the first frame member) of the photosensitive unit v together with the cleaning frame member 11. The frame member of the photosensitive unit v does not have to be integrated, and may be formed by coupling a plurality of members. Even in this case, the respective members that rotatably support both end portions of the photosensitive drum 7 are collectively called frame member of the photosensitive unit v.

A joint-shaped portion 7*b* is formed at the one end side in the axial direction of the photosensitive drum 7, and serves as a unit configured to transmit a driving force from the apparatus body A1 to the photosensitive drum 7. The photosensitive drum 7 is rotated because the joint-shaped portion 7*b* engages with a driving input joint (not shown) provided at the apparatus body A1 and receives a driving force from the apparatus body A1. In the following description, a side at which the joint-shaped portion 7*b* is provided at the photosensitive drum 7 is occasionally called driving side and a side opposite to the driving side is occasionally called non-driving side, from among both end sides in the longitudinal direction of the process cartridge B (the axial direction of the photosensitive drum 7).

A developing roller gear 13*a* is attached to the driving side of the developing roller 13. The developing roller 13 is supported at a hole 18*b* of a bearing member 18 with the developing roller gear 13*a* arranged therebetween. Also, at the non-driving side, a hole 13*b* provided at the developing roller is supported by a bearing member 19. Accordingly, the developing roller 13 is rotatably supported at both ends in the developing unit u. The bearing member 18 and the bearing member 19 are attached to the development container 10, and form the frame member (the second frame member) of the developing unit u together with the development container 10. The frame member of the developing unit u does not have to be integrated, and may be formed by coupling a plurality of members. Even in this case, the respective members that rotatably support both end portions of the developing roller 13 are collectively called frame member of the developing unit u.

A magnet roller 35 having a plurality of magnetic poles on its peripheral surface is arranged in the developing roller 13. The magnet roller 35 is used to cause the developing roller 13 to hold a magnetic developer. The shaft of the magnet roller 35 is supported at a circular hole 13*c* of the developing roller 13 at the driving side. Also, the shaft of the magnet roller 35 is fitted and fixed to a hole 19*c* having a D-shaped cross section of the roller bearing member 19 at the non-driving side. Hence, even when the developing roller 13 is rotated, the magnet roller 35 is fixed with respect to the development container 10.

The developing roller 13 is provided with the developing roller gear (a first gear) 13*a* at the one end side in the axial direction as described above. The developing roller gear 13*a* is a drive transmitting portion that receives the driving force for rotation of the developing roller 13 and transmits the driving force to the developing roller 13. The developing roller gear 13*a* meshes with a drum gear (a second gear) 7*a* attached to the one end side in the axial direction of the photosensitive drum 7, at the driving side of the process cartridge B. When the photosensitive drum 7 is rotated, the developing roller gear 13*a* receives the driving force from the drum gear 7*a*, and hence the developing roller 13 is rotated.

Support and Pressure Configurations of Developing Unit

Figure 4:
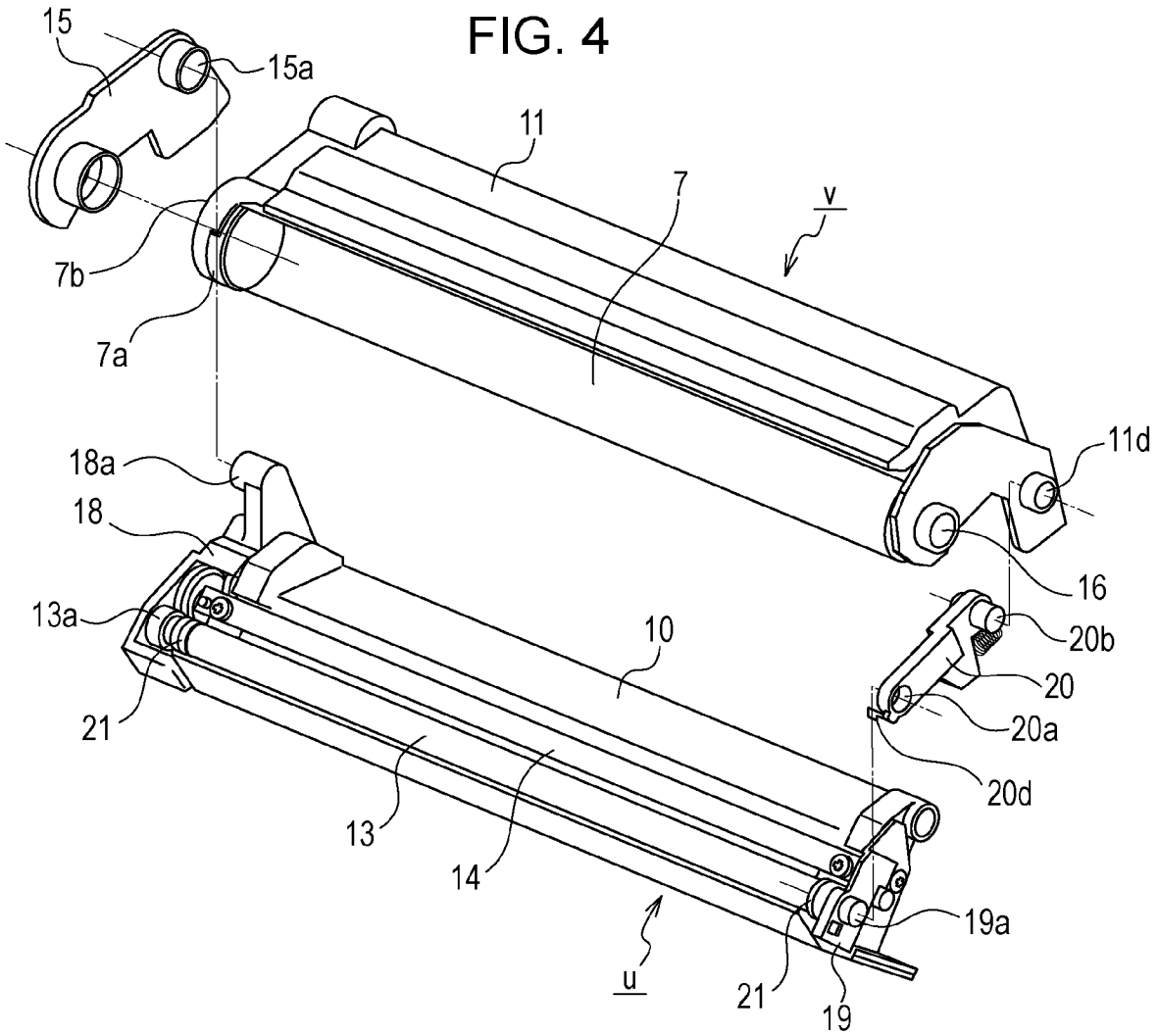
FIG. 4 is a perspective view showing an assembly configuration of a photosensitive unit and a developing unit of the process cartridge.

A support configuration of the photosensitive unit v that supports the developing unit u is described with reference to FIGS. 3A, 3B, and 4. As shown in FIG. 4, a support shaft (a shaft) 18*a* is formed at the bearing member 18 of the developing unit u at the driving side of the process cartridge B at which the joint-shaped portion 7*b* (see FIG. 3A) is provided at the photosensitive drum 7. The support shaft 18*a* is rotatably fitted to a hole 15*a* of the drum bearing member 15 and hence the support shaft 18*a* is supported by the photosensitive unit v. That is, the developing unit u is rotatably coupled with the photosensitive unit around the support shaft 18*a* as the center of rotation. Alternatively, a shaft may be provided at the photosensitive unit v, a hole may be formed at the developing unit u, and the shaft may be fitted to the hole.

That is, any configuration may be employed as long as the developing unit u is coupled with the photosensitive unit v rotatably only around the single center of the rotation at the one end side in the longitudinal direction of the process cartridge B.

In contrast, the developing unit u is supported by the photosensitive unit v through a link member 20 at the non-driving side that is opposite to the driving side. The link member 20 has a circular hole 20*a* that is a circular opening, and a shaft

20*b* that is a columnar protrusion. A shaft 19*a* that is formed at the bearing member 19 of the developing unit u is rotatably fitted to the circular hole 20*a*. The shaft 20*b* is rotatably fitted to a circular hole 11*d* that is formed at the cleaning frame member 11 of the photosensitive unit v. The circular hole 20*a* and the shaft 20*b* are coupling portions that couple the link member 20 with the developing unit u and the photosensitive unit v. Also, the shaft 19*a* of the developing unit u and the circular hole 11*d* of the photosensitive unit v are coupled portions that are coupled with the link member 20 by the circular hole 20*a* and the shaft 20*b*.

When the circular hole 20*a* is coupled with the shaft 19*a* and the shaft 20*b* is coupled with the circular hole 11*d*, the link member 20 is rotatably coupled with both the units of the developing unit v and the photosensitive unit u.

In short, in the process cartridge B according to this embodiment, the support shaft (the shaft) 18*a* couples the developing unit u with the photosensitive unit v at the driving side, and hence the developing unit u becomes rotatable relative to the photosensitive unit v around the single point. In contrast, the link member 20 couples the developing unit u with the photosensitive unit v at the non-driving side. Thus, two-part link mechanism is formed.

As shown in FIGS. 3A and 3B, ring-like spacer rollers 21 are attached to both ends of the developing roller 13. The spacer rollers 21 come into contact with the photosensitive drum 7, and hence the developing roller 13 faces the photosensitive drum 7. At this time, the process cartridge B is designed so that the rotation axis of the developing roller 13 becomes substantially parallel to the rotation axis of the photosensitive drum 7. Also, the spacer rollers 21 have a larger radius than the radius of the developing roller 13. Owing to this, a gap is generated between the surface of the photosensitive drum 7 and the developing roller 13 by the amount corresponding to the difference between the radii of the spacer rollers 21 and the developing roller 13. That is, the spacer rollers 21 are gap retaining members that come into contact with the photosensitive drum 7 and retain a constant gap between the surface of the photosensitive drum 7 and the surface of the developing roller 13.

Figure 5:
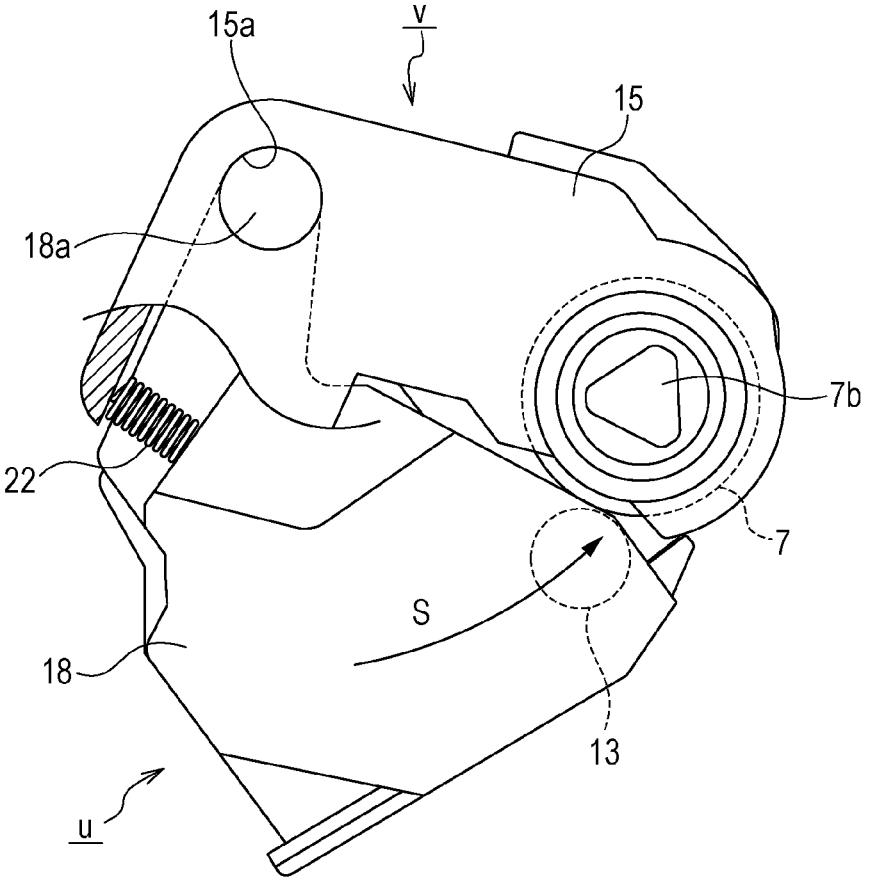
FIG. 5 is a side view at a driving side of the process cartridge.

Next, a pressure configuration that urges the developing unit u to the photosensitive unit v is described with reference to FIGS. 5 and 6. FIG. 5 illustrates a pressure configuration at the driving side of the process cartridge B. A compression spring 22 serving as an urging member is provided between the developing unit u and the photosensitive unit v. The compression spring 22 presses the developing unit u and the photosensitive unit v. The developing unit u receives a rotation moment in a direction indicated by arrow S around the support shaft 18*a* by the pressing force generated by the compression spring 22, and urges the developing roller 13 to the photosensitive drum 7.

Figure 6:
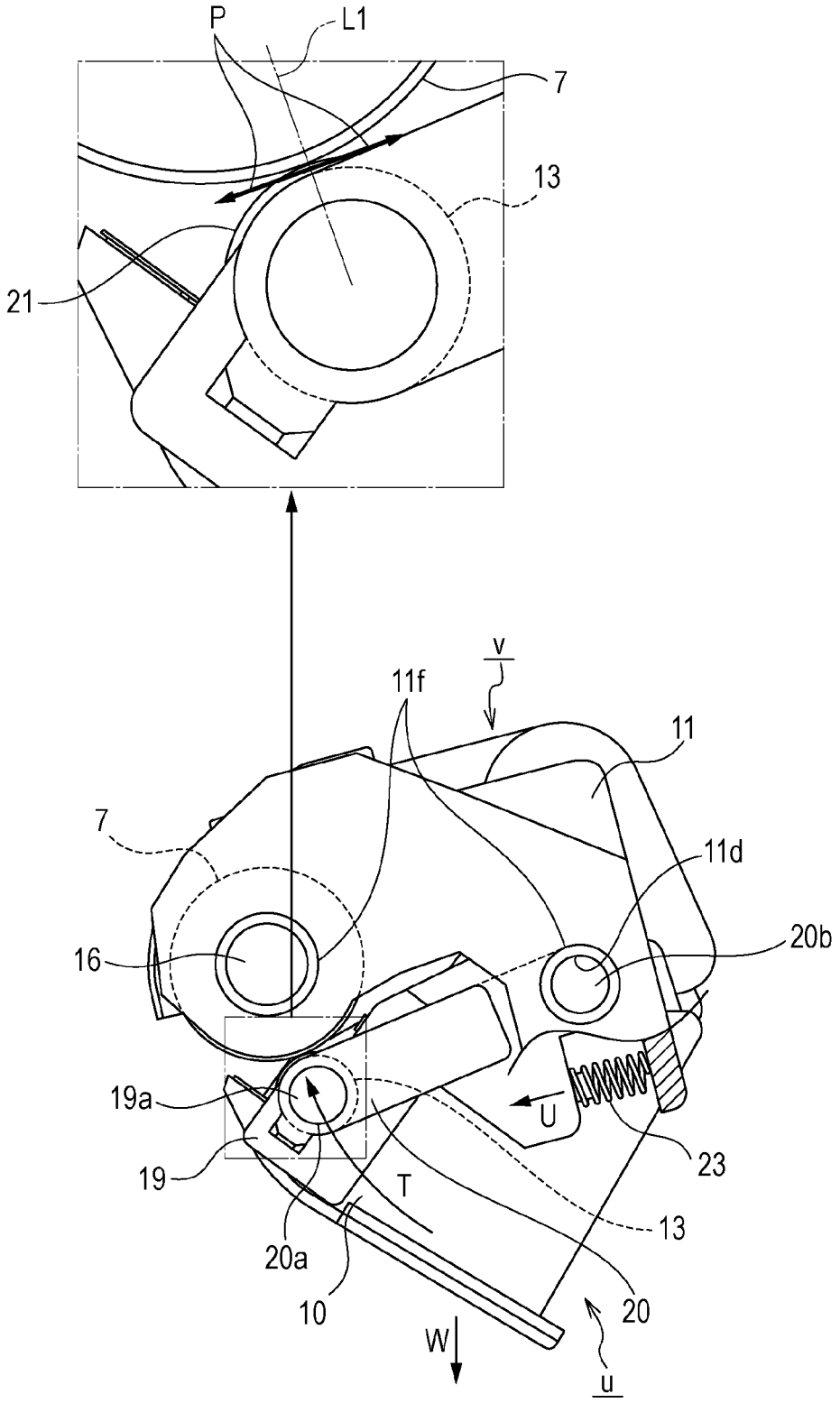
FIG. 6 is a side view at a non-driving side of the process cartridge.

FIG. 6 illustrates a pressure configuration at the non-driving side of the process cartridge B. A compression spring 23 is arranged between the link member 20 and the photosensitive unit v. The compression spring 23 presses the link member 20 and the photosensitive unit v. Like the compression spring 22, the compression spring 23 is an urging member (a first urging member) that generates an urging force for urging the developing roller 13 to the photosensitive drum. The link member 20 receives a force in a rotation direction indicated by arrow T around the shaft 20*b* by the pressing force of the compression spring 23. Since the circular hole 20*a* of the link member 20 is fitted to the shaft 19*a* of the developing unit u, the urging force of the compression spring 23 is transmitted to the developing unit u through the link member 20 and hence the developing roller 13 is urged to the photosensitive drum 7.

Since the compression spring 23 is attached to the link member 20, the urging force of the compression spring 23 can be applied in a direction in which the developing unit u moves. The urging force of the compression spring 23 can be efficiently transmitted to the developing roller 13.

As described above, the developing roller 13 is urged to the photosensitive drum 7 at the driving side and the non-driving side of the process cartridge B by using the forces of the compression spring 22 and the compression spring 23 serving as the urging members. When the developing roller 13 is urged to the photosensitive drum 7, the above-described spacer rollers 21 (see FIGS. 3A and 3B) come into contact with both end portions of the photosensitive drum 7, and retain the constant gap between the developing roller 13 and the photosensitive drum 7.

It is to be noted that the shaft 19*a* that is coupled with the link member 20 is provided coaxially with the rotation axis of the developing roller 13, in order to restrict the movement of the developing roller 13 in a direction indicated by arrow P in the figure (see FIG. 6) relative to the photosensitive drum 7 when the developing unit u is rotated around the shaft 19*a* relative to the link member 20. The direction indicated by arrow P is a direction perpendicular to a line L1 that connects the rotation axis of the photosensitive drum 7 and the rotation axis of the developing roller 13 when viewed along the axial direction of the photosensitive drum 7.

In this embodiment, the developing roller 13 does not move in the direction indicated by arrow P even when the developing roller 13 is rotated around the shaft 19*a*. Hence, the rotation axis of the developing roller 13 does not move relative to the rotation axis of the photosensitive drum 7. Accordingly, the alignment between the rotation axis of the developing roller 13 and the rotation axis of the photosensitive drum 7 can be maintained, and the gap between the developing roller 13 and the photosensitive drum 7 can be retained constant.

It is to be noted that the hole 11*d* of the photosensitive unit v that is coupled with the shaft 20*b* of the link member 20 is arranged at a position different from the position of the rotation axis of the photosensitive drum 7. This is because the developing roller 13 is required to move relative to the photosensitive drum 7 when the developing unit u moves relative to the photosensitive unit v, in order to urge the developing roller 13 to the photosensitive drum 7. In other words, the distance between the rotation axis of the developing roller 13 and the rotation axis of the photosensitive drum 7 is required to be changed.

Owing to this, at least one of situations is required in which the coupling portion that couples the link member 20 with the developing unit u is not coaxial with the developing roller 13 and in which the coupling portion that couples the link member with the photosensitive unit v is not coaxial with the photosensitive drum 7. That is, when the link member 20 is coupled with the developing unit u at a position separated from the position coaxial with the developing roller, the link member 20 may be provided to be coupled coaxially with the photosensitive drum 7. Of course, the coupling portion that couples the link member 20 with the developing unit u may be arranged at a position not coaxial with the developing roller 13, and the coupling portion that couples the link member 20 with the photosensitive unit v may be arranged at a position not coaxial with the photosensitive drum 7.

Also, for the same reason, the support shaft (the shaft) 18*a* that couples the developing unit u with the photosensitive unit v and the hole 15*a* that is coupled with the support shaft 18*a* are arranged at positions not coaxial with the rotation axes of the photosensitive drum 7 and the developing roller 13 at the driving side of the process cartridge.

When the coupling portion that couples the link member 20 with the developing unit u is arranged coaxially with the developing roller 13, the link member 20 may be directly coupled with the shaft of the developing roller 13. In this case, however, friction between the developing roller and the link member may cause wearing to occur at the link member and may affect the rotation of the developing roller. Owing to this, the material of the link member may use a material that hardly wears or a smooth material, or a lubricant may be provided between the developing roller and the link member.

In contrast, in this embodiment, the shaft 19*a* of the developing unit u that is coupled with the link member 20 is a portion that is not rotated when the electrophotographic image forming apparatus A forms an image. Hence, wearing can be prevented from occurring at the circular hole 20*a* of the link member 20 that is coupled with the shaft 19*a* without particularly limiting the material of the link member 20 or without application of the lubricant. The link member 20 can be stably coupled with the developing unit u for a long period, and hence the arrangement of the developing roller 13 with respect to the photosensitive drum 7 can be stably maintained. Also, the friction between the link member 20 and the developing unit u does not affect the rotation of the developing roller 13. As the result, the urging force of the developing roller 13 to the photosensitive drum 7 can be stably maintained.

Like the case of the developing unit u, also when the link member 20 is coupled with the photosensitive unit v, wearing of the link member 20 can be prevented by coupling the link member 20 to a portion of the photosensitive unit v, the portion which is not rotated when the electrophotographic image forming apparatus A is driven. Hence, in this embodiment, the link member 20 is coupled with the hole 11*d* provided at the cleaning frame member 11.

Figure 7:
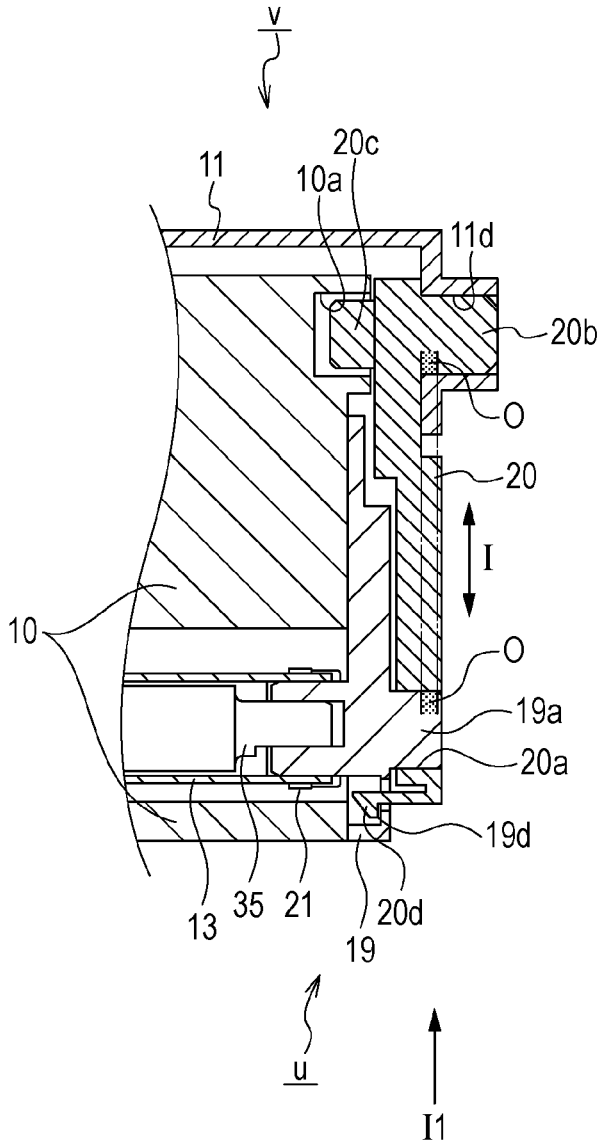
FIG. 7 is a cross-sectional view of a coupling portion of a link member.

Next, the coupling portion for coupling the link member 20 with the photosensitive unit v and the developing unit v, and a rotation restricting unit that restricts the rotation of the link member 20 are described in detail with reference to FIGS. 7, 8A and 8B. FIG. 7 is a cross-sectional view of the link member 20. The link member 20 has a claw-like portion 20*d* serving as a stopper (a movement restricting portion) with respect to the developing unit u. The claw-like portion 20*d* is elastically deformed when the link member 20 is assembled, and engages with a wall surface 19*d* of the bearing member 19. The claw-like portion 20*d* is a movement restricting portion that restricts the movement of the link member 20. More specifically, when the link member 20 is going to move to the outside in the longitudinal direction of the process cartridge B, the claw-like portion 20*d* interferes (comes into contact) with the wall surface 19*d* of the developing unit u, and hence prevents the link member 20 from being detached from the developing unit u.

In this embodiment, the movement restricting portion that prevents the link member 20 from being detached from the developing unit u is provided at the link member 20; however, the movement restricting portion that restricts the movement of the link member 20 may be provided at the developing unit u. That is, the movement restricting portion may be provided at one of the link member 20 and the developing unit u, the movement restricting portion may be brought into contact with the other one of the link member 20 and the developing unit u, and thus the movement of the link member 20 may be restricted.

As described above, the link member 20 has the circular hole 20*a* as the coupling portion for coupling the link member 20 with the developing unit u, and the shaft 20*b* as the coupling portion for coupling the link member 20 with the photosensitive unit v. The weight of the developing unit u acting in a direction indicated by arrow W and the urging force of the compression spring 23 acting in a direction indicated by arrow U shown in FIG. 6 cause a force to act on the link member 20 such that the circular hole 20*a* and the shaft 20*b* are pulled in a direction indicated by arrow I (a direction orthogonal to the longitudinal direction of the process cartridge) shown in FIG. 7. When viewed along a direction orthogonal to the longitudinal direction of the process cartridge, if the position of the circular hole 20*a* is separated from the position of the shaft 20*b*, the link member 20 may be moved and deformed when the circular hole 20*a* and the shaft 20*b* are pulled in the opposite directions. At this time, the urging force of the developing roller 13 to the photosensitive drum 7 may vary and the link member 20 may be detached from both units. Owing to this, when viewed along the direction orthogonal to the longitudinal direction of the process cartridge B, the circular hole 20*a* and the shaft 20*b* are arranged such that an overlap region O is present between a region where the link member 20 is coupled with the developing unit u and a region where the link member 20 is coupled with the photosensitive unit v. Accordingly, the link member 20 is prevented from moving relative to the developing unit u and the photosensitive unit v and from being deformed. The detail is described below.

Figure 19A:
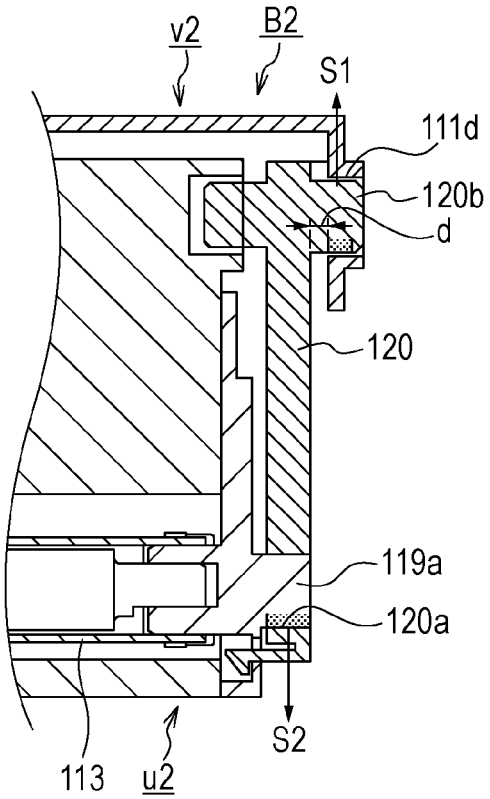
FIGS. 19A and 19B are cross-sectional views showing a process cartridge according to a comparative example.
Figure 19B:
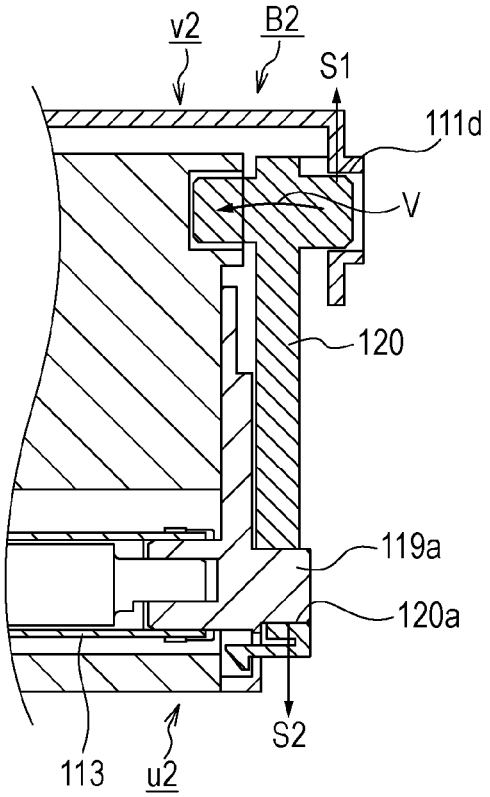

FIGS. 19A and 19B are cross-sectional views of a process cartridge B2 according to a comparative example. A link member 120 is rotatably coupled with a developing unit u2 and a photosensitive unit v2 at a non-driving side of the process cartridge B2. More specifically, a circular hole 120*a* of the link member 120 is coupled with a shaft 119*a* of the developing unit u2, and a shaft 120*b* of the link member 120 is coupled with a hole 111*d* of the photosensitive unit v2.

As shown in FIG. 19A, in the process cartridge B2 according to the comparative example, the circular hole 120*a* is separated from the shaft 120*b* by a distance d in the longitudinal direction of the process cartridge B2. In this case, a region where the circular hole 120*a* is coupled with the developing unit u2 does not overlap a region where the shaft 120*b* is coupled with the photosensitive unit v2 in the longitudinal direction. At this time, if the circular hole 120*a* and the shaft 120*b* are pulled in the opposite directions indicated by arrows S1 and S2, a rotation moment is generated at the link member 120 around the circular hole 120*a* in a direction in which the shaft 120*b* moves in a direction indicated by arrow V in FIG. 19B. As the result, as shown in FIG. 19B, the shaft 120*b* of the link member 120 may move in the direction indicated by arrow V and may be deformed. If the link member 120 moves and is deformed, the urging force of a developing roller 113 to a photosensitive drum may vary, and the link member 120 may be detached from both units u2 and v2.

Owing to this, in this embodiment, as shown in FIG. 7, the region where the link member 20 is coupled with the developing unit u overlaps the region where the link member 20 is coupled with the photosensitive unit v in the region O when viewed along the direction orthogonal to the longitudinal direction of the process cartridge B (a direction indicated by arrow I1). Accordingly, even if the circular hole 20*a* and the shaft 20*b* of the link member 20 are pulled in the direction indicated by arrow I, a rotation moment is not generated at the link member 20, and the link member 20 is prevented from moving or being deformed. Hence, the link member 20 can accurately determine the position of the developing unit u with respect to the photosensitive unit v. The urging force of the developing roller 13 to the photosensitive drum 7 can be stably maintained.

Figure 8A:
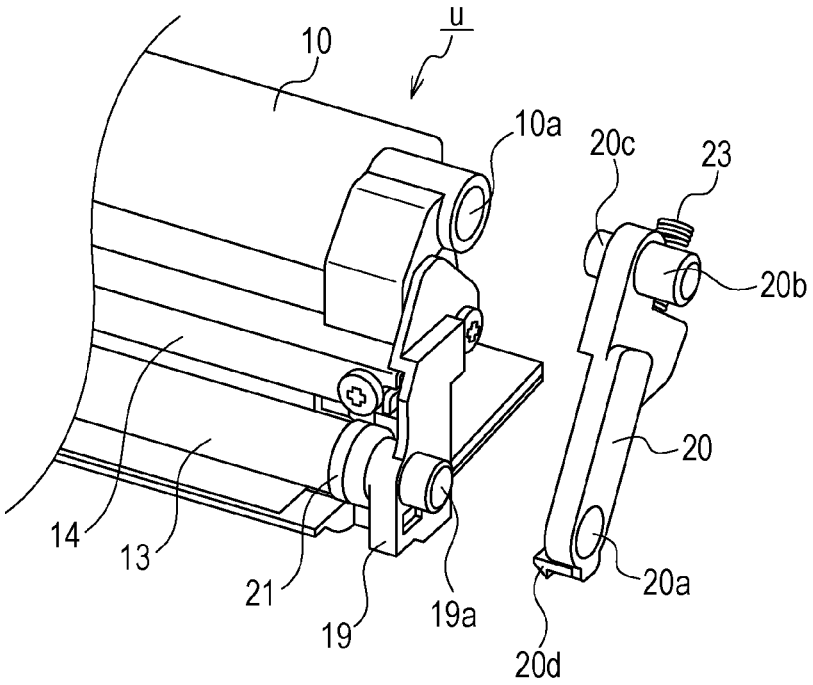
FIGS. 8A and 8B are a perspective view and a schematic illustration of a rotation restricting portion of the link member.
Figure 8B:
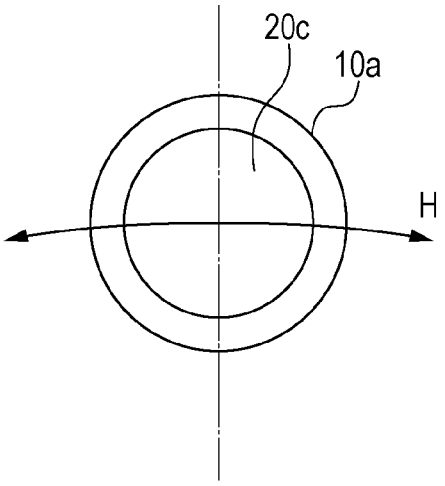

FIG. 8A is a perspective view showing a state in which the link member 20 is assembled with the developing unit u. As shown in FIG. 8A, the link member 20 has a protrusion-like rotation restricting portion (hereinafter, referred to as restricting portion) 20*c* at a side opposite to a surface at which the shaft 20*b* coupled to the photosensitive unit v is provided. Further, a hole 10*a* serving as a restricted portion is provided at the developing unit u. The restricting portion 20*c* and the hole 10*a* define a rotation restricting unit that restricts (limits) the range of rotation of the developing unit u relative to the link member 20 within a predetermined range. The configuration and effect of the restricting portion 20*c* and the hole 10*a* are described below in detail.

When the link member 20 is assembled with the developing unit u, the restricting portion 20*c* is inserted into the hole 10*a* of the development container 10. As shown in a schematic illustration in FIG. 8B, the hole 10*a* of the development container 10 has a larger diameter than the diameter of the restricting portion 20*c* of the link member 20. Hence, a gap is provided between the hole 10*a* and the restricting portion 20*c*. The link member 20 is rotatable in a direction indicated by arrow H around the hole 20*a* within the range of the gap. In contrast, if the link member 20 is going to rotate by the amount exceeding the gap provided between the hole 10*a* and the restricting portion 20*c*, the restricting portion 20*c* comes into contact with the hole 10*a*, and restricts the rotation of the link member 20.

When the driving unit u rotates relative to the link member 20 around the shaft 19*a* at the non-driving side of the process cartridge B, a force is applied to the developing unit u such that the developing unit u is rotated around the support shaft 18*a* (see FIG. 5). Since the support shaft 18*a* is arranged at the position different from the position of the shaft 19*a* when viewed along the longitudinal direction of the process cartridge, if the developing unit u is largely rotated around the support shaft 18*a* at the driving side, the driving side of the developing unit u is twisted relative to the non-driving side. Due to this, the urging force of the developing roller 13 to the photosensitive drum 7 may be uneven at both ends in the longitudinal direction. Further, the process cartridge B may be deformed or broken. In light of the situations, if the developing unit u is going to rotate around the shaft 19*a* relative to the link member by an angle exceeding a predetermined angle, the rotation is restricted because the hole 10*a* of the developing unit comes into contact with the restricting portion 20*c* of the link member 20.

It is to be noted that the restricting portion 20*c* is desirably arranged at a position far from the circular hole 20*a* of the link member 20. This is because the force received by the restricting portion 20*c* when the restricting portion 20*c* comes into contact with the hole 10*a* during rotation of the link member 20 around the circular hole 20*a* in the direction indicated by arrow H in FIG. 8B decreases as the distance of the restricting portion 20*c* from the circular hole 20*a* increases. Hence, in the case of this embodiment, the restricting portion 20*c* is arranged coaxially with the shaft 20*b* as shown in FIG. 7.

With the above-described configuration, even if an external force is applied to the developing unit u, for example, during distribution of the process cartridge, and if the developing unit u is going to rotate relative to the link member 20, the restricting portion 20*c* restricts the rotation. Accordingly, the urging force of the developing roller 13 to the photosensitive drum 7 can become stable, and also deformation and breakage of the process cartridge can be prevented.

In this embodiment, the protrusion-like restricting portion 20*c* is provided at the link member 20 to serve as the rotation restricting unit that restricts the range of the rotation of the developing unit u relative to the link member 20, and the restricting portion 20*c* is brought into contact with the restricted portion (the hole 10*a*) provided at the developing unit u. Alternatively, the restricting portion of the link member 20 may be a hole and the restricted portion of the developing unit u may be a protrusion. Still alternatively, the range of the rotation of the developing unit u relative to the link member 20 may be restricted by providing a restricting portion and a restricted portion respectively at the developing unit u and the photosensitive unit v. More specifically, if the developing unit u is rotated relative to the link member 20 by an angle equal to or larger than a predetermined angle, the restricting portion provided at, or proximate to, the developing unit u may be brought into contact with the restricted portion provided at, or proximate to, the photosensitive unit v, and hence the rotation of the developing unit u may be restricted.

Arrangement of Link Member

First, the arrangement of the link member 20 in a view from a side surface of the process cartridge B (when the process cartridge B is viewed along the axial direction of the photosensitive drum 7) is described with reference to FIGS. 10 and 11.

Figure 10:
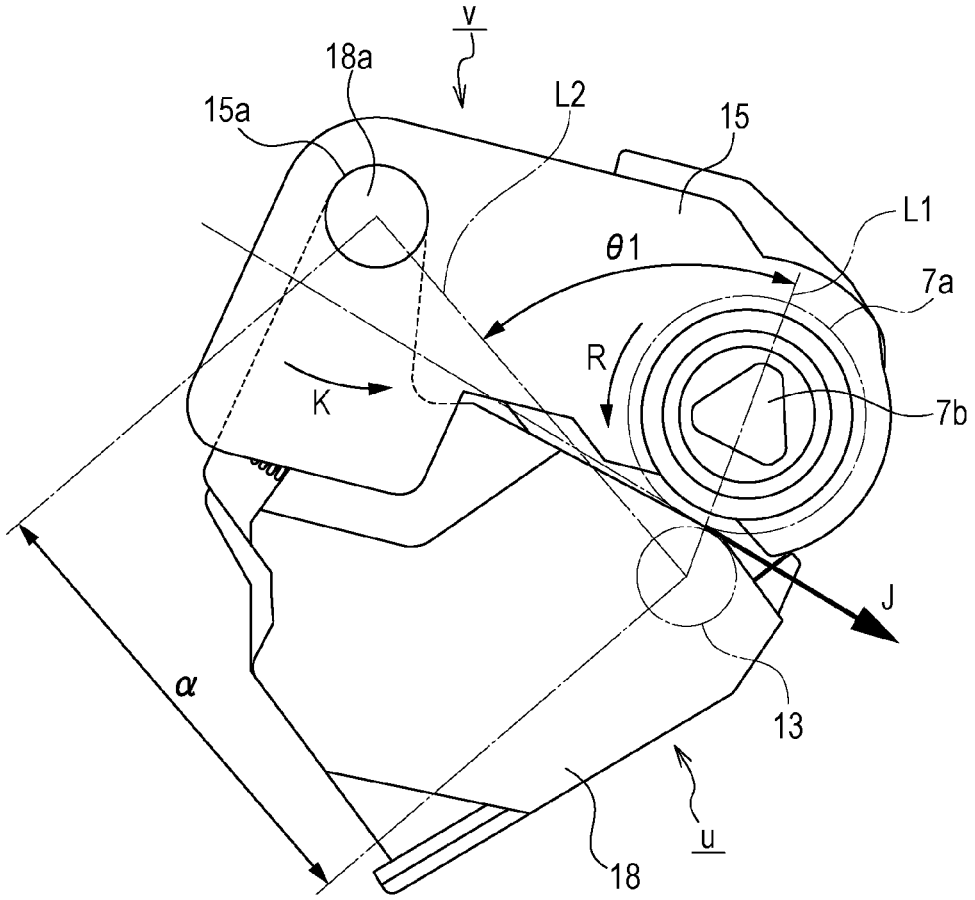
FIG. 10 is a side view at the driving side of the process cartridge.

FIG. 10 is a side view of the process cartridge B when viewed along the axial direction of the photosensitive drum 7, and FIG. 10 is a side view at the driving side. FIG. 10 illustrates the arrangement of the support shaft 18*a* that is the coupling portion for coupling the developing unit u with the photosensitive unit v and the hole 15*a* of the photosensitive unit v that is coupled to the support shaft 18*a*. As described above, the developing roller 13 is rotationally driven when the developing roller gear 13*a* provided at the driving side of the developing roller 13 is driven by the drum gear 7*a* formed at the driving side of the photosensitive drum 7. The driving force received by the developing roller gear 13*a* from the drum gear 7*a* causes a gear meshing force J to be generated at the developing unit u in a pressure angle direction of the developing roller gear 13*a* and the drum gear 7*a*. In this embodiment, the support shaft 18*a* of the developing unit u is arranged at a side opposite to the position of the rotation axis of the developing roller 13 with respect to a line extending in the direction in which the meshing force J is generated. This is a position at which a rotation moment is generated at the developing unit u in a direction indicated by arrow K by the gear meshing force J. This rotation moment causes the developing roller 13 to be urged to the photosensitive drum 7. Hence, the developing roller 13 does not move away from the photosensitive drum 7 because of the gear meshing force J during image formation.

Next, the arrangement of the link member 20 at the non-driving side of the process cartridge B is described with reference to FIG. 11. FIG. 11 is a side view of the process cartridge B when viewed along the axial direction of the photosensitive drum 7, and FIG. 11 is a side view at the non-driving side.

In this embodiment, it is assumed that a line L1 (a first line) is a line connecting the rotation axis of the developing roller 13 and the rotation axis of the photosensitive drum 7, and a line L3 (a third line) is a line connecting the center of the shaft 20*b* of the link member 20 and the rotation axis of the developing roller 13. The shaft 20*b* of the link member 20 is the coupling portion that rotatably couples the link member 20 with the photosensitive unit v at the non-driving side of the process cartridge B. Hence, the line L3 (the third line) is a line connecting the center of the rotation of the link member 20 relative to the photosensitive unit v and the rotation axis of the developing roller 13.

The link member 20 is arranged so that an angle θ2 defined by the line L1 and the line L3 becomes the right angle. Accordingly, when the link member 20 is rotated by the compression spring 23 in a direction indicated by arrow T around the shaft 20*b*, the urging force of the compression spring 23 efficiently acts in a direction in which the developing roller 13 is urged to the photosensitive drum 7 (a direction indicated by arrow M).

Figure 11:
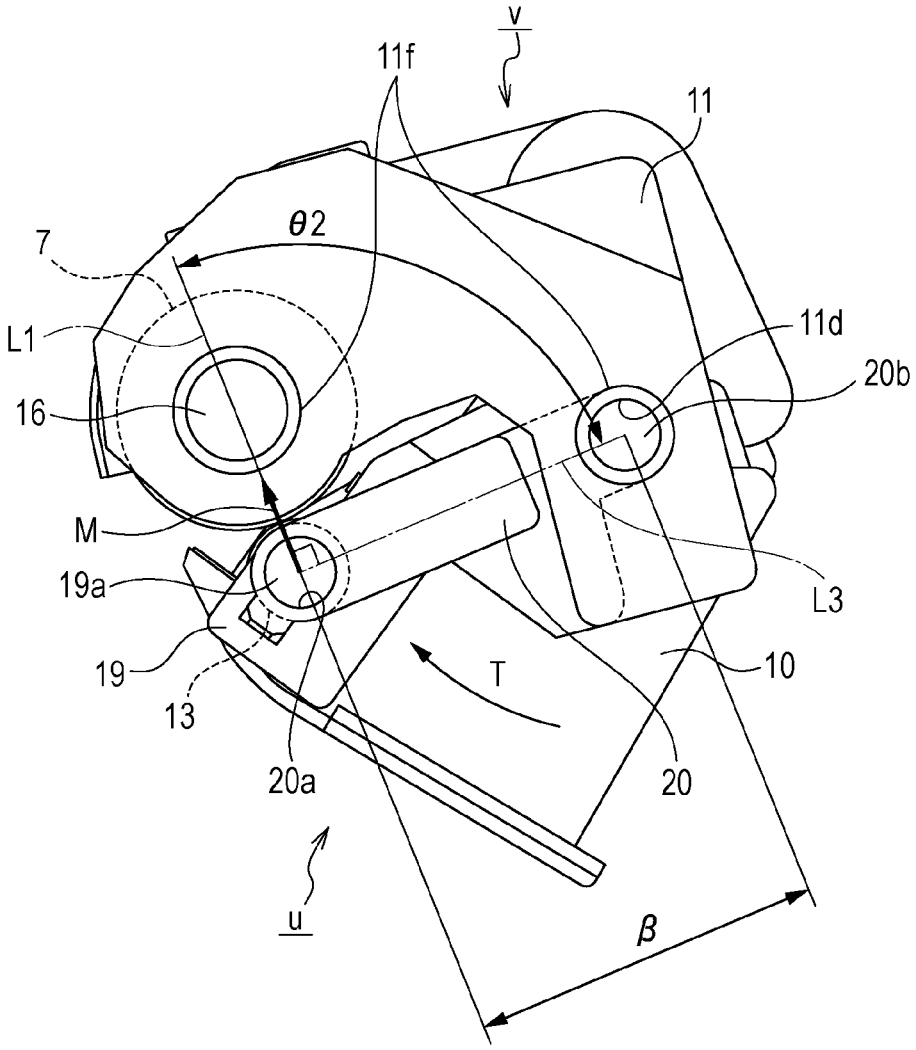
FIG. 11 is a side view at the non-driving side of the process cartridge.

Also, even if the angle θ2 cannot be arranged at the right angle unlike FIG. 11, the arrangement desirably satisfies the following condition. As shown in FIG. 10, it is assumed that a line L2 (a second line) at the driving side is a line connecting the center of the rotation (the support shaft 18*a*) of the developing unit u relative to the photosensitive unit v and the rotation axis of the developing roller 13. It is assumed that an angle defined by the line L2 and the line L1 connecting the rotation axis of the developing roller 13 and the rotation axis of the photosensitive drum 7 is an angle θ1 (see FIG. 10). The above-mentioned angle θ2 is desirably closer to the right angle than the angle θ1.

By satisfying this relationship, even at the non-driving side at which the developing unit u is not directly coupled with the photosensitive unit v, the urging force of the compression spring 23 can be efficiently transmitted in the direction in which the developing roller 13 urges the photosensitive drum 7 (the M direction).

As described above, the support shaft 18*a* of the developing unit u is required to be arranged at the side opposite to the side at which the rotation axis of the developing roller 13 is located with respect to the line extending in the direction in which the meshing force J is generated (see FIG. 10). Owing to this, it is difficult to make the angle θ1 close to 90°, the angle θ1 which is defined by the line L1 connecting the rotation axis of the developing roller 13 and the rotation axis of the photosensitive drum 7 and the line L2 connecting the support shaft 18*a* by which the developing unit u is coupled with the photosensitive unit v and the rotation axis of the developing roller 13.

Since the link member 20 is provided at the side opposite to the side at which the developing roller gear 13*a* and the drum gear 7*a* are located in the longitudinal direction of the process cartridge B, the link member 20 is hardly affected by the meshing force J. Hence, the link member 20 may be arranged regardless of the effect of the meshing force J (see FIG. 10). Thus, the angle θ2 may be a value close to 90°, so that the link member 20 may be arranged at a position at which the urging force can be efficiently transmitted to the developing roller 13.

Further in this embodiment, when the process cartridge B is viewed along the longitudinal direction of the process cartridge B (the axial direction of the photosensitive drum 7), the support shaft 18*a* of the development container 10 is separated form the rotation axis of the developing roller 13 by a distance α at the driving side of the process cartridge B as shown in FIG. 10. In contrast, the shaft 20*b* of the link member is separated from the rotation axis of the developing roller 13 by a distance β at the non-driving side as shown in FIG. 11.

This embodiment is configured such that the distance β is smaller than the distance α. That is, $\beta<\alpha$ is established. Accordingly, the link member 20 and the process cartridge B can be downsized. Also, since the link member 20 is downsized, the degree of bending of the link member 20 when a force is applied to the link member 20 decreases. Accordingly, the link member 20 can accurately retain the position of the developing unit v with respect to the photosensitive unit v.

Next, the arrangement of the link member 20 and the compression spring 23 when the process cartridge B is viewed along the direction orthogonal to the longitudinal direction of the process cartridge B is described next with reference to FIGS. 6, 12, and 13.

Figure 12:
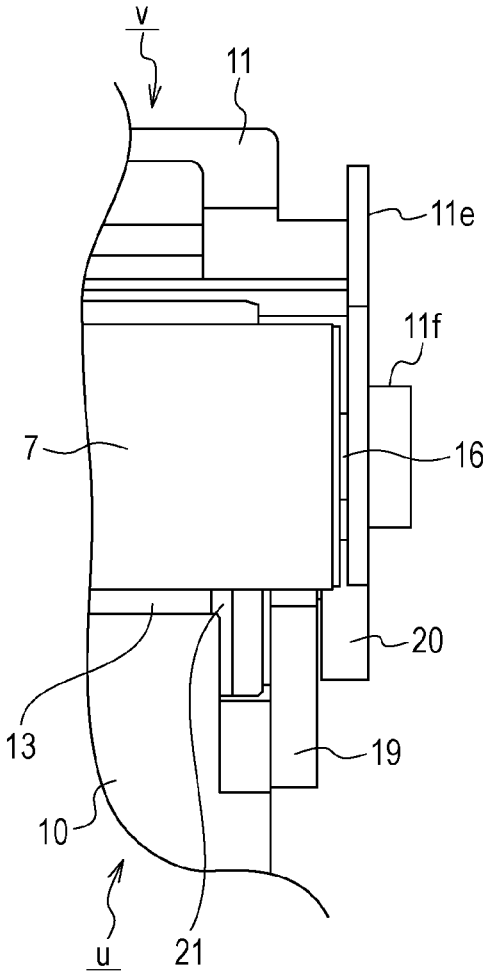
FIG. 12 is a front view at the non-driving side of the process cartridge.

FIG. 12 is a front view at the non-driving side of the process cartridge B. The link member 20 and the compression spring 23 (see FIG. 6) are arranged at the inner side in the longitudinal direction with respect to a side surface 11*e* of the photosensitive unit v, and hence do not protrude from the side surface 11*e* of the photosensitive unit. As shown in FIGS. 3A and 3B, since the photosensitive drum 7 is typically longer than the developing roller 13 in the longitudinal direction, the total length of the photosensitive unit v is larger than the total length of the developing unit u in the longitudinal direction. Since the link member 20 is arranged between the side surface of the photosensitive unit v and the side surface of the developing unit v in the longitudinal direction, the link member 20 and the compression spring 23 can be arranged so as not to protrude from the side surface lie (FIG. 12) of the photosensitive unit v. Accordingly, the process cartridge B can be downsized in the longitudinal direction.

Figure 13:
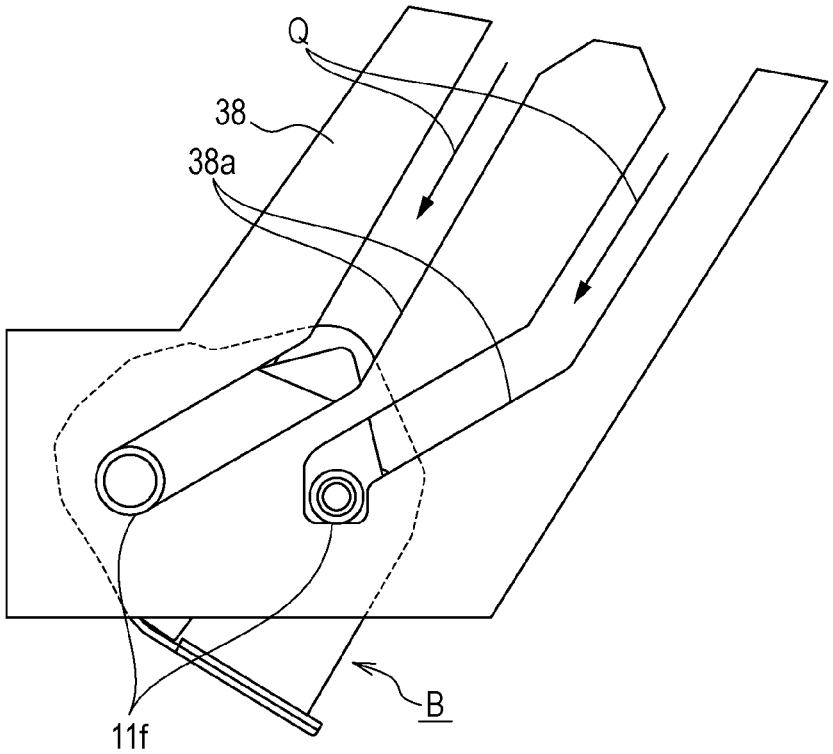
FIG. 13 is a side view showing mounting of the process cartridge onto an apparatus body of the image forming apparatus.

FIG. 13 is a schematic illustration showing a state in which the process cartridge B is mounted on the apparatus body A1. The process cartridge B is mounted in a direction indicated by arrow Q while two positioning portions 11*f* protruding from the side surface lie of the photosensitive unit v are guided by grooves 38*a* of a body guide 38. Since the link member 20 or the compression spring 23 does not protrude in the longitudinal direction of the process cartridge B, the apparatus body A1 can be also downsized.

Restriction of One-Side Contact

The developing unit u of this embodiment is coupled with the photosensitive unit v through the link member 20 at the non-driving side, and is rotatably coupled with the photosensitive unit v by the support shaft 18*a* provided at the developing unit u at the driving side. Accordingly, even if the alignment between the rotation axis of the developing roller 13 and the rotation axis of the photosensitive drum 7 is deviated from the relationship expected at the time of design, one-side contact of the developing roller 13 with respect to the photosensitive drum 7 can be prevented.

A first reason is that since the link member 20 is rotatable relative to both the units of the developing unit u and the photosensitive unit v, the degree of freedom when the developing unit u moves relative to the photosensitive unit v is large. Even if the alignment between the rotation axis of the photosensitive drum 7 and the rotation axis of the developing roller 13 is deviated, the developing unit u can move relative to the photosensitive unit v in a direction in which both end portions of the developing roller 13 move to come into contact with the photosensitive drum 7 through the spacer rollers 21.

Figure 9:
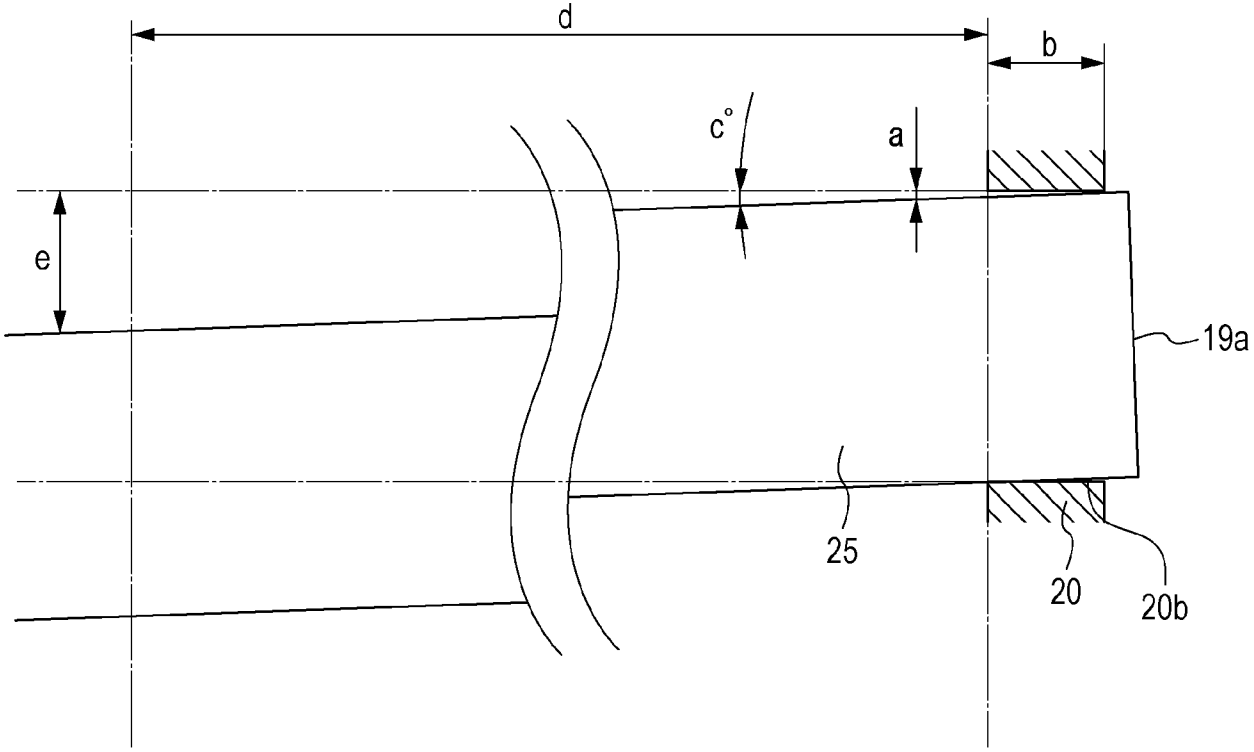
FIG. 9 is a schematic illustration showing a fitting state of the link member.

A second reason for preventing the one-side contact of the developing roller 13 with respect to the photosensitive drum is that the developing unit u is inclined with respect to the link member 20 in a direction intersecting with the axial direction of the developing roller (in the vertical direction in FIG. 9). In this embodiment, in order to rotatably couple the shaft 19*a* of the developing unit u with the circular hole 20*a* of the link member 20, the circular hole 20*a* and the shaft 19*a* are loosely fitted to each other. A very small gap in a range from about 10 to 80 μm is generated between the circular hole 20*a* and the shaft 19*a*. FIG. 9 is a schematic illustration showing the fitting state of the shaft 19*a* and the circular hole 20*a*. For example, a case is assumed in which the gap between the circular hole

20*a* of the link member 20 and the shaft 19*a* of the developing unit u is a=13 μm, and the fitting width of the circular hole 20*a* in the longitudinal direction of the process cartridge B is b=3 mm. In this case, an imaginary shaft 25 provided by imaginarily drawing the shaft 19*a* that is coupled with the circular hole 20*a* in the longitudinal direction of the process cartridge may be inclined by an angle of c=0.25° at maximum with respect to the link member 20. If the imaginary shaft 25 is inclined by the maximum angle of c=0.25°, the imaginary shaft 25 moves by a distance e=1 mm in the vertical direction in FIG. 9 at a position separated from the circular hole 20*a* by a distance d=230 mm in the longitudinal direction.

The vertical direction in FIG. 9 is a direction orthogonal to the longitudinal direction of the process cartridge B, i.e., the radial direction of the photosensitive drum 7. That is, the driving side of the developing unit u moves in the radial direction of the photosensitive drum relative to the non-driving side that is coupled with the link member 20.

Even if the position of the driving side of the developing unit is determined in the radial direction of the photosensitive drum, the non-driving side of the developing unit u can move in the radial direction of the photosensitive drum because the shaft 19*a* is inclined with respect to the link member 20.

The compression spring 22 and the compression spring 23 are respectively provided at the driving side and the non-driving side of the process cartridge B, and urge both end portions of the developing roller 13 to the photosensitive drum 7. Since the non-driving side of the developing unit u can move relative to the driving side, the developing unit u moves in a direction in which both end portions of the developing roller 13 come into contact with the photosensitive drum 7. Accordingly, the one-side contact of the developing roller 13 with respect to the photosensitive drum 7 can be prevented.

Conclusion

In the past, the one-side contact of the developing roller with the photosensitive drum may occur, and the contact pressures at both end portions of the developing roller with respect to the photosensitive drum may become unbalanced.

Also, in order to correct the one-side contact of the developing roller, the developing unit or the photosensitive unit has to be previously urged by a large force. At this time, a large load is applied to support portions that support the developing roller and the photosensitive drum. Hence, the torque required for driving the developing roller or the photosensitive drum may be increased. Also, to allow the support portions to resist the large load, the strength of the support portions has to be increased, for example, by selecting a material with a high durability.

In this embodiment, with the above-described configuration, the one-side contact of the developing roller 13 with respect to the photosensitive drum 7 is prevented, and the weight of the developing unit u and the urging forces of the compression springs 22 and 23 can be reliably transmitted to the photosensitive drum 7 through both end portions of the developing roller 13. As the result, the urging forces at both ends of the developing roller 13 with respect to the photosensitive drum 7 are balanced and hence become stable.

Also in this embodiment, since the one-side contact of the developing roller 13 is prevented, the forces of the compression springs 22 and 23 for urging the developing unit u, the photosensitive unit v, and the link member 20 can be decreased. Hence, a large load is not applied to the developing roller 13, the photosensitive drum 7, or the frame members for supporting the units. The durability of the process cartridge B increases. Also, a phenomenon in which the torque required for driving the photosensitive drum 7 or the developing roller 13 is increased as the result of the large load applied to the units can be prevented.

Further, when the process cartridge B is assembled, a process of checking whether the urging force of the developing roller 13 with respect to the photosensitive drum 7 is proper or not can be omitted.

Also, in this embodiment, to prevent the one-side contact of the developing roller 13 with respect to the photosensitive drum 7, the entire developing unit u moves, but the developing roller 13 does not move relative to the frame member of the developing unit u. Hence, the developing roller 13 can maintain its positional relationship with respect to the members fixed to the frame member of the developing unit u. For example, the development blade 14 (see FIG. 2) is fixed to the development container 10, and directly comes into contact with the developing roller 13. When the electrophotographic image forming apparatus A forms an image, the positional relationship between the development blade 14 and the developing roller 13 is fixed. Hence, the development blade 14 can stably regulate the amount of the developer that is held on the developing roller 13.

Also in this embodiment, the process cartridge B in which the link member 20, the developing unit u, and the photosensitive unit v are integrally formed is employed as the image forming unit of the electrophotographic image forming apparatus A. Hence, a user does not have to mount the developing unit u and the photosensitive unit v separately on the apparatus body A1. Also, when the user mounts the process cartridge B on the apparatus body A1, the user does not have to assemble the link member 20 with the developing unit u and the photosensitive unit v. Accordingly, operability when the user handles the electrophotographic image forming apparatus A can be increased.

Modification

In this embodiment, the process cartridge B employs, as the developing system, the non-contact developing system in which the spacer rollers 21 are provided at both end portions of the developing roller 13 and hence a gap is provided between the developing roller 13 and the photosensitive drum 7. However, the present invention is not limited thereto. The present invention can be applied to a contact developing system in which a developing roller made of an elastic member is urged to and brought into contact with a photosensitive drum.

Figure 31A:
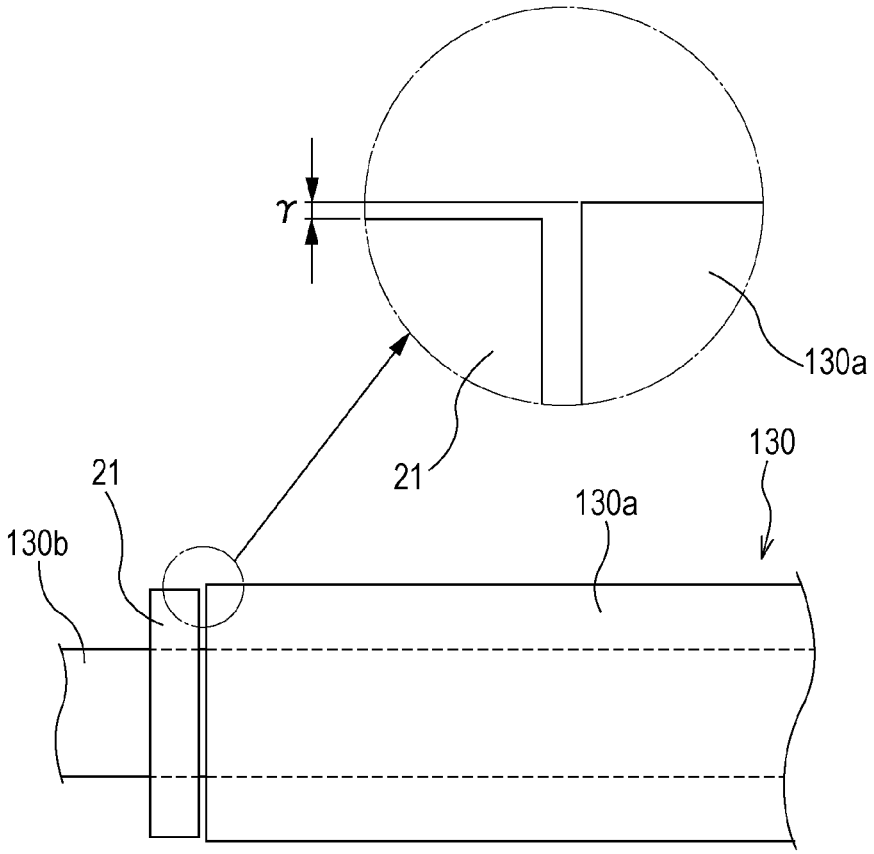
FIGS. 31A and 31B are schematic illustrations showing a non-contact developing system.
Figure 31B:
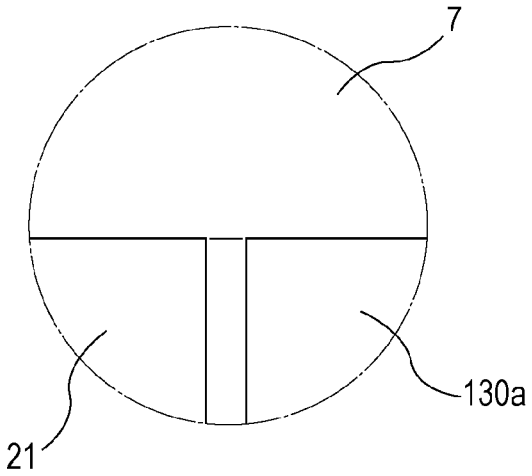

FIGS. 31A and 31B are schematic illustrations showing the relationship between the developing roller and the photosensitive drum used for the process cartridge of the contact developing system. In FIG. 31A, a developing roller 130 has a roller portion 130*a* made of an elastic member (rubber) and a core bar portion 130*b* made of a metal shaft to which the roller portion 130*a* is fixed. Both ends of the core bar portion 130*b* of the developing roller 130 are supported in the developing unit rotatably by bearing members (not shown).

Spacer rollers 21 are attached to both end portions of the roller portion 130*a* rotatably relative to the core bar portion 130*b*. The roller portion 130*a* has a radius that is larger only by γ than the radius of the spacer rollers 21.

FIG. 31B shows a state in which the developing roller 130 is urged to the photosensitive drum 7. The photosensitive drum 7 comes into contact with both the roller portion 130*a* and the spacer rollers 21. At this time, the photosensitive drum 7 causes the roller portion 130*a*, which is formed of the elastic rubber, of the developing roller to be deformed only by a deformation amount γ until the photosensitive drum 7 comes into contact with the spacer rollers 21. In other words, in the contact developing system, the spacer rollers 21 serve as a deformation-amount regulating member that regulates the deformation amount, by which the developing roller 130 is deformed when the developing roller 130 comes into contact with the photosensitive drum 7, to be constant.

With the above-described configuration, the roller portion 130*a* of the developing roller comes into contact with the photosensitive drum 7, so that a developer layer formed on the surface of the roller portion 130*a* is transferred on the photosensitive drum 7. If the urging force of the developing roller 130 to the photosensitive drum 7 has a sufficiently large value so that the photosensitive drum 7 comes into contact with the spacer rollers 21, an incoming amount γ of the roller portion 130*a* into the photosensitive drum 7 (the deformation amount γ of the roller portion 130*a*) can be stably maintained.

By applying the present invention, even in the contact developing system, the urging force by which the developing roller is urged to the photosensitive drum can become stable, and a phenomenon in which the urging force becomes unbalanced in the axial direction of the photosensitive drum can be prevented. Accordingly, the incoming amount of the roller portion 130*a* of the developing roller 130 into the photosensitive drum 7 (the deformation amount γ of the roller portion 130*a*) can be maintained, and the electrophotographic image forming apparatus can form a good image.

Second Embodiment

Figure 14:
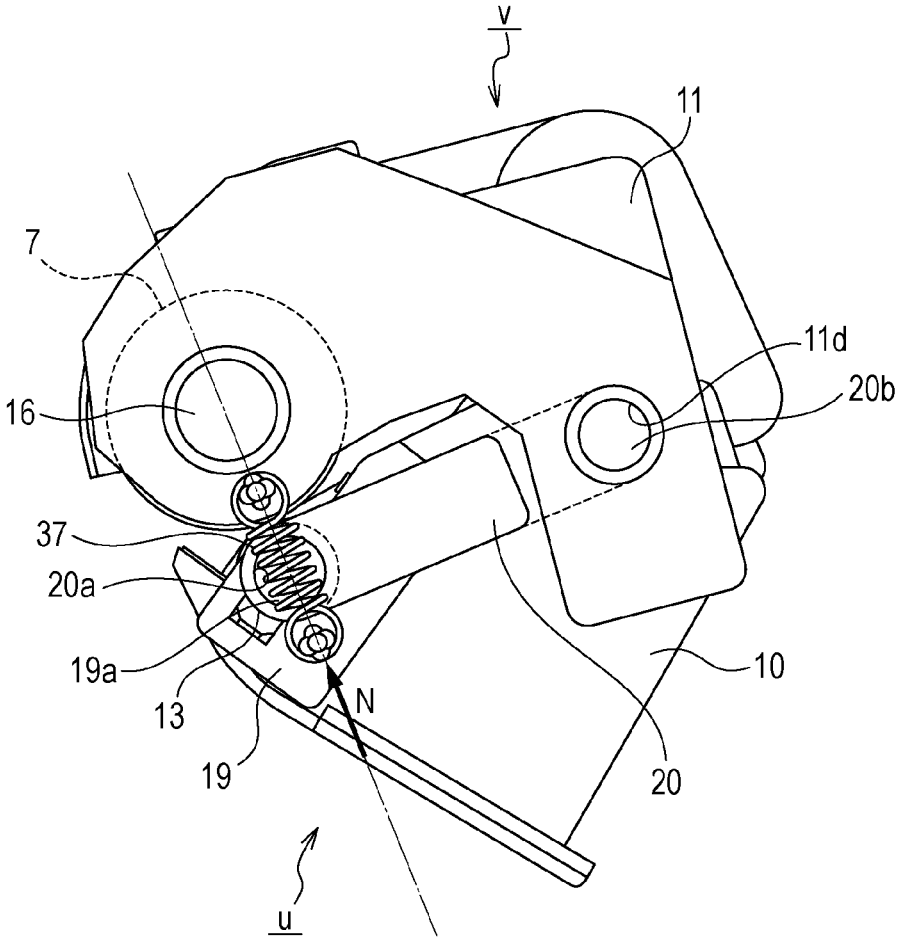
FIG. 14 is a side view at a non-driving side of a process cartridge according to a second embodiment.

Other embodiment to which the present invention is applied is described. FIG. 14 is a side view of a process cartridge B according to this embodiment when viewed along the axial direction of the photosensitive drum 7. FIG. 14 is a side view at the non-driving side. This embodiment differs from the first embodiment in that a tension spring 37 is attached between the developing unit u and the photosensitive unit v, as an urging member (a second urging member) that urges the developing roller 13 to the photosensitive drum 7. The tension spring 37 applies a force in a direction indicated by arrow N, urges the developing unit u to the photosensitive drum v, and urges the developing roller 13 to the photosensitive drum 7.

In this embodiment, the tension spring 37 is arranged such that the developing roller 13 and the photosensitive drum 7 are positioned on a line extending in the direction indicated by arrow N in which the tension spring 37 applies the force. This is to restrict the rotation of the developing unit u around the shaft 19*a* that is the coupling portion with respect to the link member 20 when the tension spring 37 applies the force in the N direction.

Particularly in this embodiment, when the line is drawn in the direction in which the tension spring 37 applies the force (the direction indicated by arrow N), the line connects the rotation axis of the developing roller 13 with the rotation axis of the photosensitive drum 7. The arrangement of the tension spring 37 at this time is the most desirable in order to restrict the rotation of the developing unit u around the shaft 19*a*. Of course, the line extending in the direction indicated by arrow N does not have to pass through the rotation axis of the developing roller 13 and the rotation axis of the photosensitive drum 7. The above-described advantage can be attained if the line overlaps at least partly the developing roller 13 and the photosensitive drum 7.

Also, with the configuration of this embodiment, since the urging force of the tension spring 37 is applied in the direction in which the developing roller 13 is urged to the photosensitive drum 7, the developing roller 13 can be stably urged to the photosensitive drum 7.

Third Embodiment

Figure 15:
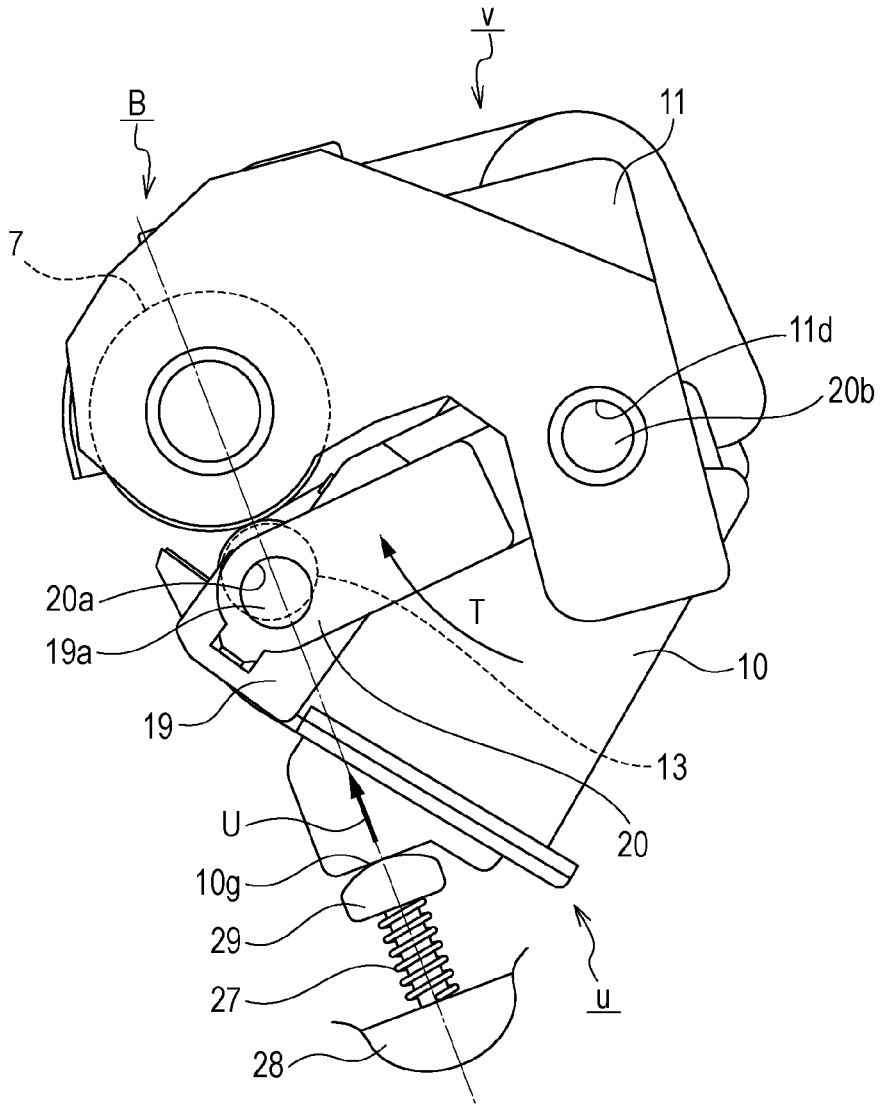
FIG. 15 is a side view at a non-driving side of a process cartridge according to a third embodiment.

Other embodiment to which the present invention is applied is described. FIG. 15 is side view at the non-driving side of a process cartridge B according to this embodiment. This embodiment differs from the first embodiment in that the shaft 19*a* of the developing unit u that is coupled with the link member 20 is not coaxial to the rotation axis of the developing roller 13.

In recent years, the diameter of the developing roller 13 is desired to be decreased to downsize the process cartridge B. If the diameter of the developing roller 13 according to the first embodiment is decreased, the distance F (see FIG. 3B) between the rotation axis of the developing roller 13 and the rotation axis of the photosensitive drum 7 is decreased. At this time, the shape of the link member 20 has to be downsized so that the link member 20 does not interfere with the photosensitive unit v at the periphery of the circular hole 20*a*.

In this embodiment, the position of the shaft 19*a* for coupling the developing unit u with the link member 20 is moved to a position farther from the rotation axis of the photosensitive drum than the rotation axis of the developing roller 13 when viewed along the axial direction of the photosensitive drum 7. Accordingly, in the process cartridge B in which the developing roller 13 is downsized, the periphery of the circular hole 20*a* hardly interferes with the photosensitive unit v. Hence, even if the diameter of the developing roller 13 is decreased, the shape of the periphery of the circular hole 20*a* does not have to be downsized. The strength of the link member 20 can be maintained. The link member 20 can stably urge the developing roller 13 to the photosensitive drum 7.

The distance by which the position of the shaft 19*a* is separated from the rotation axis of the developing roller 13 is properly determined within a range in which the developing roller 13 does not markedly move in the radial direction of the photosensitive drum 7 when the developing unit u is rotated around the shaft 19*a*. In this embodiment, the shaft 19*a* partly overlaps the developing roller 13 when viewed along the axial direction of the photosensitive drum 7, and the center of the shaft 19*a* is arranged within the region of the developing roller 13.

Further, in this embodiment, a compression spring 27 that urges the developing unit u is attached to the apparatus body A1, as a configuration different from the first embodiment. The compression spring 27 is a body urging member attached to a frame member 28 of the apparatus body A1. A tip member 29 is attached to a side of the compression spring 27 that comes into contact with the process cartridge B. When the process cartridge B is mounted on the apparatus body A1 and the tip member 29 comes into contact with a force receiving portion 10*g* provided at the development container 10, the developing unit u is pressed in a direction indicated by arrow U. Accordingly, the link member 20 and the developing unit u that is coupled with the link member 20 are rotated in a direction indicated by arrow T around the shaft 20*b* of the link member 20, and the developing roller 13 is urged to the photosensitive drum 7.

Further, the compression spring 27 is arranged such that when a line is drawn in a direction in which the compression spring 27 urges the developing unit u (in a direction indicated by arrow U in FIG. 15), the developing roller 13 and the photosensitive drum 7 are positioned on the line. The above-described arrangement of the compression spring 27 is desirable because the force of the compression spring 27 is efficiently transmitted in the direction in which the developing roller 13 urges the photosensitive drum 7.

Also, the force of the compression spring 27 at this time hardly acts in a direction in which the developing unit u is rotated relative to the link member 20. Accordingly, the developing unit u can be prevented from being deformed, and the alignment between the developing roller 13 and the photosensitive drum 7 can be prevented from being deviated. Thus, the developing roller 13 can be stably urged to the photosensitive drum 7.

Particularly in this embodiment, the compression spring 27 is arranged such that the line extending in the direction in which the compression spring 27 applies the force (in the direction indicated by arrow U) connects the rotation axis of the developing roller 13 and the rotation axis of the photosensitive drum 7. At this time, the urging force of the compression spring 27 can be the most efficiently transmitted to the process cartridge B.

Of course, alternatively, the compression springs 22 and 23 described in the first embodiment or a member similar to the tension spring 37 described in the second embodiment may be provided at the process cartridge B in this embodiment instead of the compression spring 27 provided in the apparatus body A1 of the image forming apparatus.

Fourth Embodiment

Figure 16:
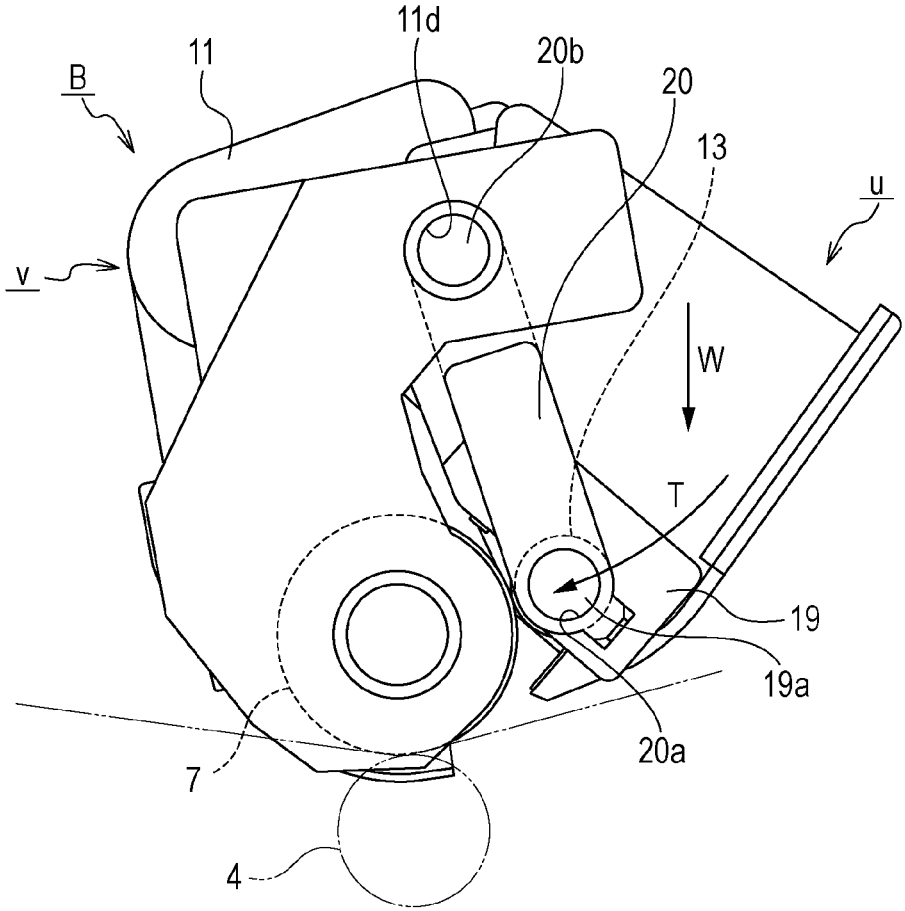
FIG. 16 is a side view at a non-driving side of a process cartridge according to a fourth embodiment.

Other embodiment to which the present invention is applied is described. FIG. 16 is side view at the non-driving side of a process cartridge B according to this embodiment. In the first embodiment, the developing roller 13 is urged to the photosensitive drum 7 by using the compression springs 22 and 23. In contrast, in this embodiment, the developing unit u urges the developing roller 13 to the photosensitive drum 7 by a weight W of the developing unit u, instead of the urging forces of the compression springs 22 and 23. In this embodiment, the process cartridge B is arranged in the apparatus body A1 such that the developing roller 13 is rotated in a direction in which the developing unit u urges the developing roller 13 to the photosensitive drum 7 (in a direction indicated by arrow T) around the shaft 20*b*.

If the weight W of the developing unit u is sufficiently large, as long as the above-described configuration is provided, the developing roller 13 can be stably urged to the photosensitive drum 7 without an urging member such as a spring.

Fifth Embodiment

Figure 17:
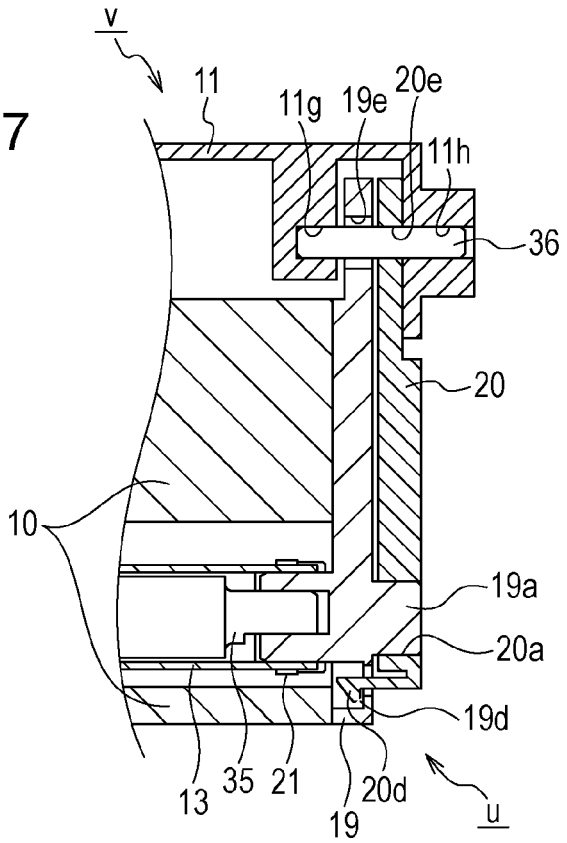
FIG. 17 is a cross-sectional view of a coupling portion of a link member according to a fifth embodiment.

Other embodiment to which the present invention is applied is described. FIG. 17 is a cross-sectional view of a coupling portion of the link member 20 according to this embodiment. In this case, a coupling pin 36 is provided as a shaft member at the link member 20, and the link member 20 is rotatably coupled with the photosensitive unit v through the coupling pin 36. The coupling pin 36 penetrates through a hole 19*e* provided at the bearing member 19 of the developing unit u and a hole 20*e* provided at the link member 20. Further, the coupling pin 36 is inserted into two holes 11*g* and 11*h* provided at the photosensitive unit v, and fixes the link member 20 to the photosensitive unit v.

Also, like the first embodiment, the link member has the hole 20*a*, and the shaft 19*a* provided at the developing unit u is rotatably coupled with the hole 20*a*.

Herein, the hole 19*e* of the developing unit u has a larger diameter than the diameter of the coupling pin 36, and hence a gap is provided between the hole 19*e* and the coupling pin 36. Accordingly, like the first embodiment, the developing unit u is rotated around the shaft 19*a* within the range of the gap. The coupling pin 36 inserted into the hole 19*e* of the developing unit restricts the rotation of the developing unit u by an angle equal to or larger than a predetermined angle relative to the link member 20, like the rotation restricting portion 20*c* (see FIGS. 8A and 8B) described in the first embodiment. More specifically, if the developing unit u is rotated by an angle exceeding the predetermined angle around the shaft 19*a*, the coupling pin 36 comes into contact with the shaft 19*a* of the developing unit u, thereby restricting the rotation of the developing unit u.

With this embodiment, by fitting the coupling pin 36 with the link member 20, the link member 20 is coupled with the photosensitive unit v, and further the rotation restricting portion can be formed at the link member 20. Also, the coupling pin 36 serves as the coupling portion that couples the link member 20 with the photosensitive unit v, and also serves as the rotation restricting portion that restricts the rotation of the developing unit u. Thus, the coupling portion and the rotation restricting portion can be integrally formed.

Sixth Embodiment

Figure 18:
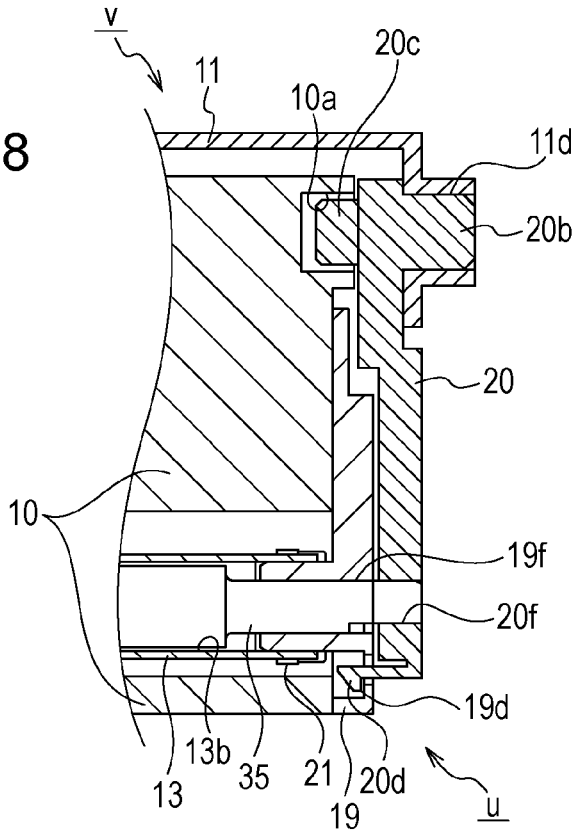
FIG. 18 is a cross-sectional view of a coupling portion of a link member according to a sixth embodiment.

Other embodiment to which the present invention is applied is described. FIG. 18 is a cross-sectional view of a coupling portion of the link member 20 according to this embodiment. In this embodiment, the link member 20 is coupled with the magnet roller 35, which is provided in the developing roller 13, and hence the link member 20 is coupled with the developing unit u.

At the driving side, the magnet roller 35 is supported in the developing unit u at the circular hole 13*c* (see FIG. 3A) provided at the developing roller 13 like the first embodiment. In contrast, at the non-driving side, the magnet roller 35 is supported at a circular hole 19*f* provided at the bearing member 19. As described above, the magnet roller 35 is rotatably supported at the circular holes 13*c* and 19*f*. Then, at the non-driving side of the process cartridge B, the magnet roller 35 is fixed to and supported at a hole 20*f* having a D-shaped cross section of the link member 20. That is, one end side of the magnet roller 35 is rotatably supported by the frame member of the developing unit u, and the other end thereof is fixed to the link member 20.

With this embodiment, coupling between the developing unit u and the link member 20, and assembling of the magnet roller 35 can be simultaneously performed.

Alternatively, the magnet roller 35 may be fixed to the development container 10 and then the link member 20 may be rotatably coupled with the magnet roller 35. In either case, since the magnet roller 35 is not rotationally driven when the electrophotographic image forming apparatus A forms an image, even if the magnet roller 35 is coupled with the link member 20, the link member 20 can be prevented from wearing. Accordingly, the link member 20 can retain the position of the developing roller 13 with respect to the photosensitive drum 7 until the process cartridge B reaches the end of its life.

The link member 20 does not have to be coupled with the magnet roller 35. The link member 20 can be stably coupled with any portion as long as the portion is not rotated in association with the rotation of the developing roller 13 when the electrophotographic image forming apparatus A forms an image.

Seventh Embodiment

Figure 20:
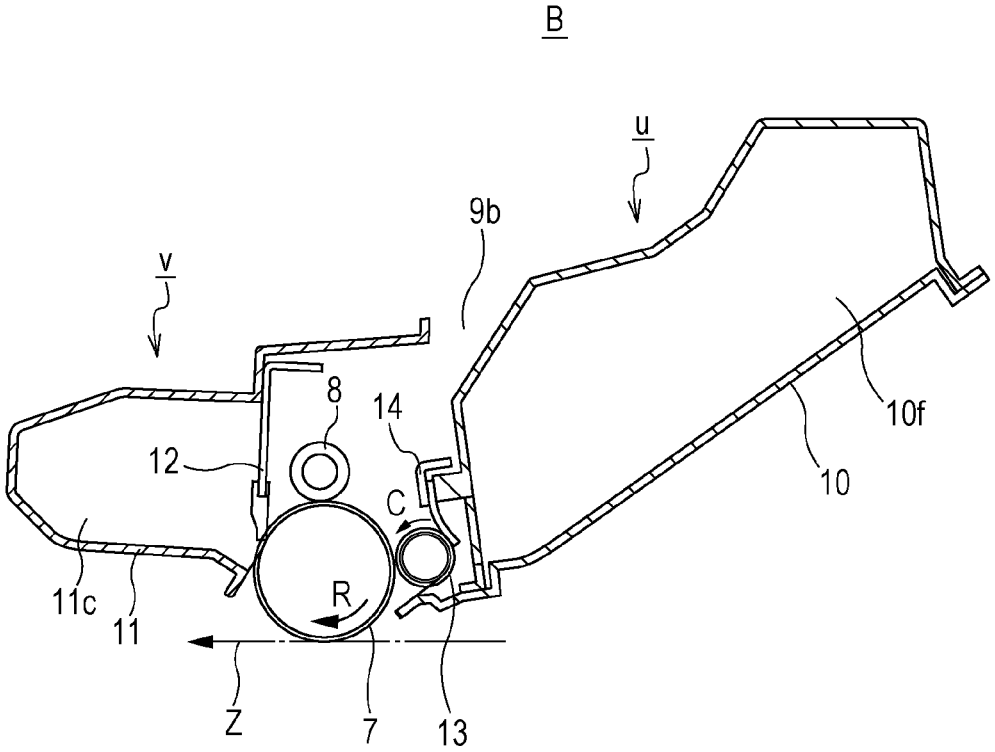
FIG. 20 is a side sectional view showing the general configuration a process cartridge according to a seventh embodiment.

A configuration according to other embodiment of the present invention is described. FIG. 20 is a cross-sectional view of a process cartridge B according to this embodiment.

This embodiment differs from the above-described embodiment in that a sheet passes through a position at a lower surface of the process cartridge B in a direction indicated by arrow Z and an image is transferred on the sheet from a photosensitive drum 7. Also, a developing unit u and a photosensitive unit v are arranged at both left and right sides of the photosensitive drum 7 when the process cartridge B is viewed in an axial direction of the photosensitive drum 7. Laser light is emitted on an upper surface of the photosensitive drum 7 from an optical system (not shown) through an exposure opening 9*b* arranged between the developing unit u and the photosensitive unit v. This laser light forms an electrostatic latent image on the photosensitive drum 7. It is to be noted that members having similar functions as those of the above-described embodiments are described by using the same reference signs in this embodiment.

Figure 21:
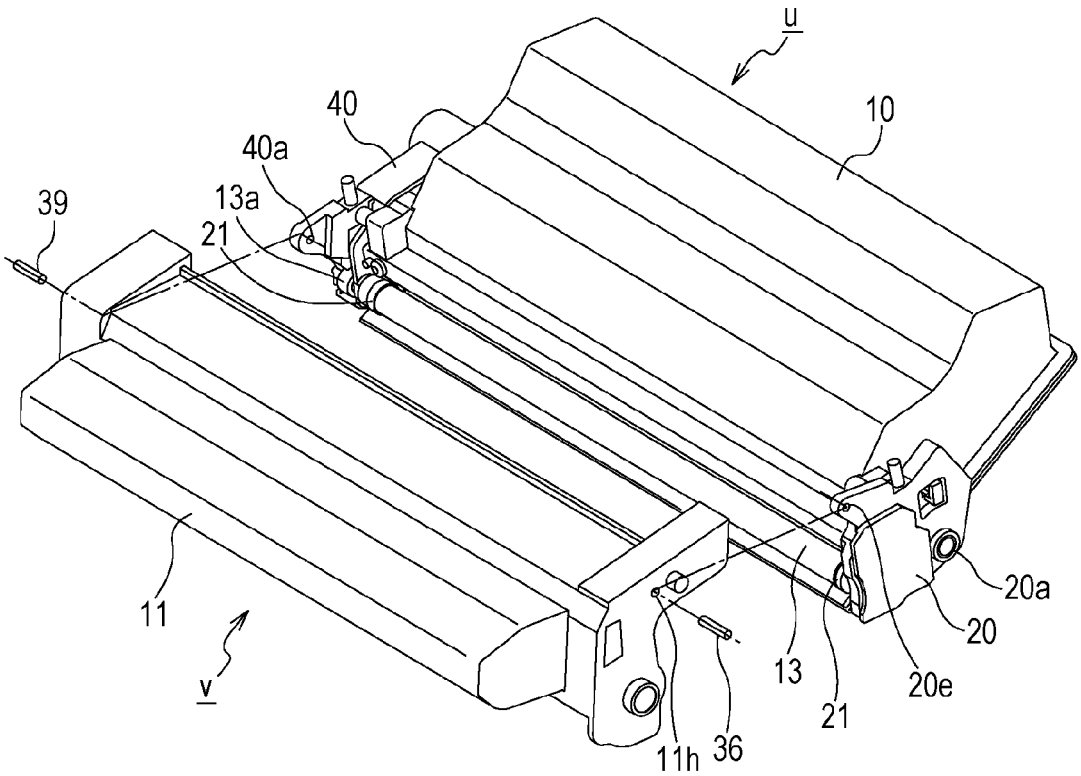
FIG. 21 is a perspective view showing an assembly configuration of a photosensitive unit and a developing unit of the process cartridge according to the seventh embodiment.
Figure 22:
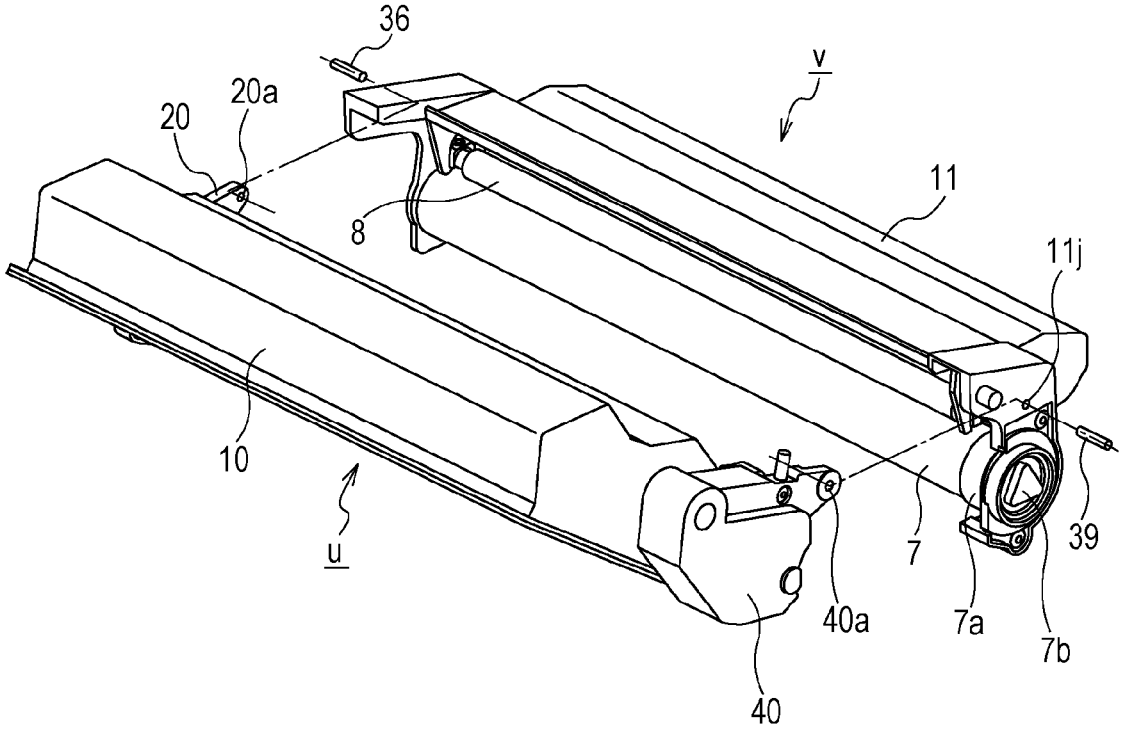
FIG. 22 is a perspective view showing the assembly configuration of the photosensitive unit and the developing unit of the process cartridge according to the seventh embodiment.

A coupling configuration (a connecting configuration) of the photosensitive unit v and the developing unit u according to this embodiment is described with reference to FIG. 21. FIG. 21 is a perspective view of the photosensitive unit v and the developing unit u viewed from the non-driving side. FIG. 22 is a perspective view of the photosensitive unit v and the developing unit u shown in FIG. 21 when viewed from the driving side.

As shown in FIG. 22, a joint-shaped portion 7*b* that transmits a driving force from an apparatus body A1 to the photosensitive drum 7 is provided at one end side of the process cartridge B in the axial direction of the photosensitive drum 7. Even in this embodiment, one of both end sides of the process cartridge B in the axial direction of the photosensitive drum 7 provided with the joint-shaped portion 7*b* is called driving side. Also, the other of both end sides of the process cartridge not provided with the joint-shaped portion 7*b* is called non-driving side.

Like the above-described embodiments, the photosensitive drum 7 is rotationally driven when the joint-shaped portion 7*b* provided at the driving side of the photosensitive drum 7 engages with a driving input joint (not shown) provided at the apparatus body A1 and a driving force is transmitted to the photosensitive drum 7. A developing roller 13 is rotationally driven when a drum gear 7*a* provided at the driving side of the photosensitive drum 7 engages with a developing roller gear 13*a* provided at the driving side of the developing roller 13 and a driving force is transmitted from the photosensitive drum 7 to the developing roller 13. Also, spacer rollers (gap retaining members) 21 functioning similarly to those of the above-described embodiments are provided at both ends of the developing roller 13.

As shown in FIG. 22, at the driving side of the process cartridge B, the developing unit u is rotationally coupled with the photosensitive unit v by a coupling pin 39. The coupling pin 39 at the driving side is fitted to a hole 11*j* provided at a cleaning frame member 11 of the photosensitive unit v and a hole 40*a* provided at a cover member 40 of the developing unit u.

In contrast, at the non-driving side shown in FIG. 21, a link member 20 is rotatably coupled with the photosensitive unit v by a coupling pin 36. The coupling pin 36 at the non-driving side is fitted to a hole 11*h* of the cleaning frame member and a hole 20*e* of the link member. Also, a hole 20*a* of the link member 20 engages with the developing unit u, and hence the link member 20 is rotatably coupled with the developing unit u.

Figure 23:
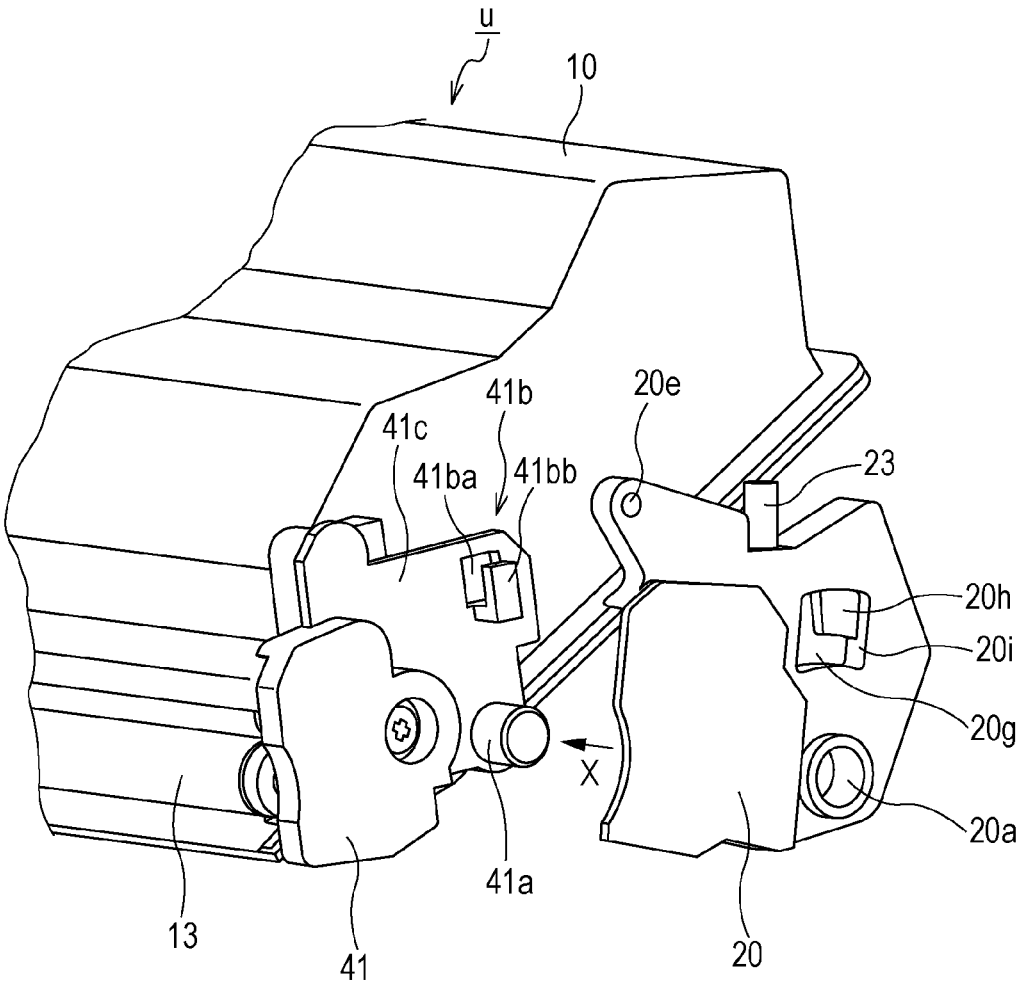
FIG. 23 is a perspective view showing the assembly configuration of the developing unit and the link member according to the seventh embodiment.
Figure 24A:
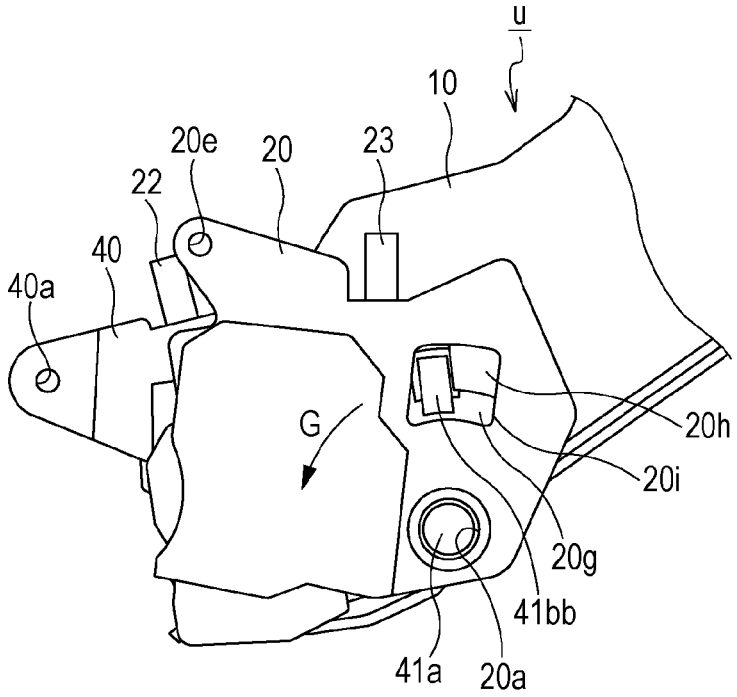
FIGS. 24A and 24B are side views of the developing unit and the link member according to the seventh embodiment.
Figure 24B:
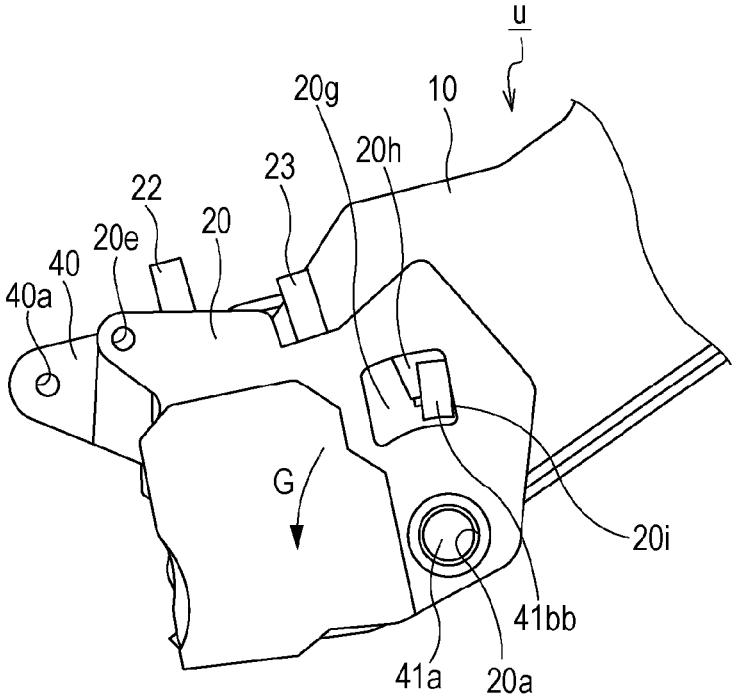

An engagement configuration between the developing unit u and the link member 20 is described below in detail with reference to FIGS. 23, 24A, and 24B. FIG. 23 is a perspective view showing an attaching method of the link member 20 to the developing unit u. FIGS. 24A and 24B are side views of the developing unit u in a view from the non-driving side provided with the link member 20.

As shown in FIG. 23, the developing unit u is provided with a bearing member 41 that is fixed to a development container 10. The development container 10 and the bearing member 41 form a frame member of the developing unit u. The bearing member 41 rotatably supports one end of the developing roller 13. Also, the bearing member 41 has a shaft 41*a* that is fitted to the hole 20*a* of the link member 20, and a restricting portion 41*b* that restricts the movement of the link member 20.

The restricting portion 41*b* has a hook 41*bb*, and a groove 41*ba* formed between the hook 41*bb* and a wall surface 41*c* of the bearing member 41. The link member 20 has the hole 20*a* to which the above-mentioned shaft 41*a* is fitted, and a restricting hole 20*g* into which the hook 41*bb* is inserted. Also, a restricting wall 20*h* is formed at part of the restricting hole 20*g*.

FIG. 24A illustrates a state in which the link member 20 is moved in a direction indicated by arrow X in FIG. 23, the shaft 41*a* of the beating member 41 is fitted to the hole 20*a* of the link member 20, and the hook 41*bb* is inserted into the hole 20*g*. The link member 20 is rotatably fitted to the shaft 41*a* of the bearing member 41 around the hole 20*a*. FIG. 24B illustrates a state in which the link member 20 is rotated in a direction indicated by arrow G around the hole 20*a* from the state in FIG. 24A. In FIG. 24B, the restricting wall 20*h* of the link member 20 enters the groove 41*ba* (see FIG. 23) of the restricting portion 41*b* provided at the bearing member 41. At this time, the restricting wall 20*h* of the link member 20 and the hook 41*bb* of the restricting portion 41*b* restricts the movement of the link member 20 relative to the shaft 41*a* in a direction opposite to the X direction in FIG. 23. That is, the restricting wall 20*h* of the link member 20 and the hook 41*bb* of the developing unit u serve as a movement restricting portion that restricts the movement of the link member 20 to the outside in the longitudinal direction of the process cartridge by coming into contact with each other.

Assembly Process of Process Cartridge

An assembly process of the process cartridge, for example, an assembly process of the process cartridge B according to this embodiment is described below with reference to FIGS. 21 through 24B. When the process cartridge B is assembled, a development-side link attachment process is performed in which the link member 20 is attached to the developing unit u as described above. More specifically, as shown in FIG. 23, the shaft 41*a* of the developing unit u is fitted to the hole 20*a* of the link member 20, and the hook 41*bb* of the developing unit u is inserted into the hole 20*g* of the link member 20.

After the development-side link attachment process, a unit coupling process in which the development unit u is coupled with the photosensitive unit v, and a photosensitive-member-side link attachment process in which the link member 20 is coupled with the photosensitive unit v are performed. More specifically, in the unit coupling process, the coupling pin 39 is inserted into the hole 40*a* of the developing unit u and the hole 11*j* of the photosensitive unit v at the driving side of the process cartridge as shown in FIG. 22, so that the developing unit u is coupled with the photosensitive unit v.

In the photosensitive-member-side link attachment process, as shown in FIG. 21, the coupling pin 36 is inserted into the hole 20*e* of the link member 20 and the hole 11*h* of the photosensitive unit v at the non-driving side of the process cartridge B, so that the link member 20 is coupled with the photosensitive unit v.

Further, this embodiment has a measure for preventing the link member 20 from being detached from the developing unit u during the development-side link attachment process, the unit coupling process, and the photosensitive-member-side link attachment process, and in a period between a certain process to the next process. Accordingly, the assembly work of the process cartridge B is facilitated. The measure (method) is described below with reference to FIGS. 24A and 24B.

The center of gravity of the link member 20 is located at the left side of the hole 20*a* of the link member in FIGS. 24A and 24B. Since the hole 20*a* is the center of the rotation of the link member 20 relative to the developing unit u, the link member 20 constantly tends to rotate in the direction indicated by arrow G in FIGS. 24A and 24B by the weight of the link member 20. In particular, as shown in FIG. 24B, the link member 20 rotates in the direction indicated by arrow G until a wall surface 20*i* of the restricting hole 20*g* comes into contact with the hook 41*bb* of the restricting portion 41*b* provided at the developing unit u. When the wall surface 20*i* of the link member 20 comes into contact with the hook 41*bb* of the developing unit u, the rotation of the link member 20 is stopped (in a rotation restricted state).

This embodiment is configured such that, when the process cartridge B is assembled, the posture of the developing unit u is retained in a predetermined state, and the link member 20 becomes the rotation restricted state shown in FIG. 24B by the weight of the link member 20.

When the link member 20 is in the rotation restricted state shown in FIG. 24B, as described above, the link member 20 can restrict the movement of the process cartridge B in the longitudinal direction. More specifically, when the link member 20 is in the rotation restricted state, as shown in FIG. 24B, the position of the restricting wall 20*h* of the link member and the position of the hook 41*bb* of the developing unit u (the bearing member 41) are aligned with each other when viewed along the longitudinal direction of the process cartridge B (the axial direction of the photosensitive drum 7). When the link member 20 is moved in the longitudinal direction, the hook 41*bb* of the developing unit u comes into contact with the restricting wall 20*h* of the link member 20, thereby restricting the movement of the link member 20. That is, the link member 20 is prevented from being detached form the developing unit u.

As described above, since the posture of the developing unit u is retained at a predetermined posture during the assembly process of the process cartridge B, the link member 20 is rotated by its weight to a position at which the rotation restricting portion (the wall surface 20*i*) and the movement restricting portion (the restricting wall 20*h*) function. In this state, the link member 20 is prevented from being detached form the developing unit u. Accordingly, since a work for fixing the link member 20 etc. can be omitted during the work for the process cartridge B, workability can be increased.

In this embodiment, the posture of the developing unit u is retained at the predetermined posture and the link member 20 is in the rotation restricted state (see FIG. 24B) in all of the development-side link attachment process, the unit coupling process, and the photosensitive-member-side link attachment process. Alternatively, the posture of the developing unit u may be retained at a predetermined posture in part of the above-described processes.

Movement Restricting Unit

Figure 28:
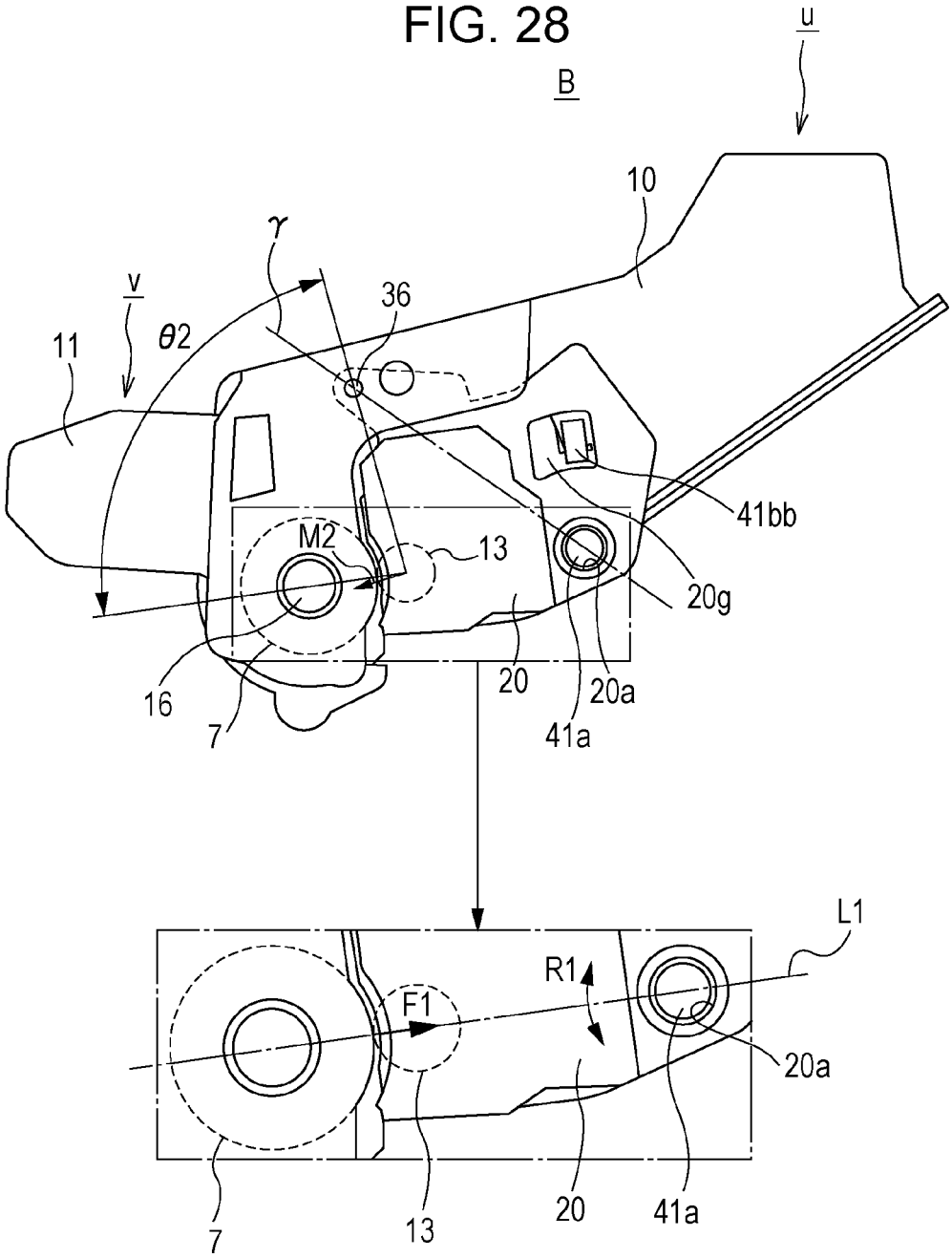
FIG. 28 is a side view at the non-driving side of the process cartridge according to the seventh embodiment.

Next, the configuration and effect of a unit configured to restrict the movement and rotation of the link member 20 are described in more detail with reference to FIG. 28. FIG. 28 is a side view at the non-driving side of the process cartridge B.

In this embodiment, the rotation restricting unit formed of the hook 41*bb* provided at the developing unit u and the wall surface 20*i* provided at the link member 20 restricts the rotation amount of the developing unit u relative to the link member 20 within a predetermined range. More specifically, when the developing unit u is going to rotate relative to the link member 20 by an angle exceeding a predetermined angle, the wall surface 20*i* serving as the restricting portion comes into contact with the hook 41*bb* serving as the restricted portion, and hence the rotation is restricted. As the result, like the above-described embodiments, the non-driving side of the developing unit u can be prevented from being twisted relative to the driving side.

Also in this embodiment, the rotation restricting unit not only restricts the rotation of the developing unit u, but also provides an effect of preventing the link member 20 from being detached. That is, the hook 41*bb* of the developing unit u forming the rotation restricting unit comes into contact with the restricting wall 20*h* provided at the link member 20 when the link member 20 moves in the axial direction of the photosensitive drum 7. The movement of the link member 20 is restricted, and hence the link member 20 can be prevented from being detached from the developing unit u. The restricting wall 20*h* is a wall surface that is adjacent to the wall surface 20*i* and is substantially orthogonal to the wall surface 20*i*.

That is, in this embodiment, the rotation of the developing unit u relative to the link member 20 is restricted, and the movement of the link member 20 to the outside in the longitudinal direction of the process cartridge B is restricted by using the hook 41*bb* provided at the developing unit u. In other words, the rotation restricting unit configured to restrict the rotation of the developing unit u (in this embodiment, the hook 41*bb* serving as the restricted portion) also serves as the movement restricting portion that restricts the movement of the link member 20. Accordingly, the space required for arrangement of the rotation restricting unit and the movement restricting portion in the process cartridge B can be reduced, and hence the process cartridge B can be downsized.

Developing Unit Pressure Configuration

Figure 25:
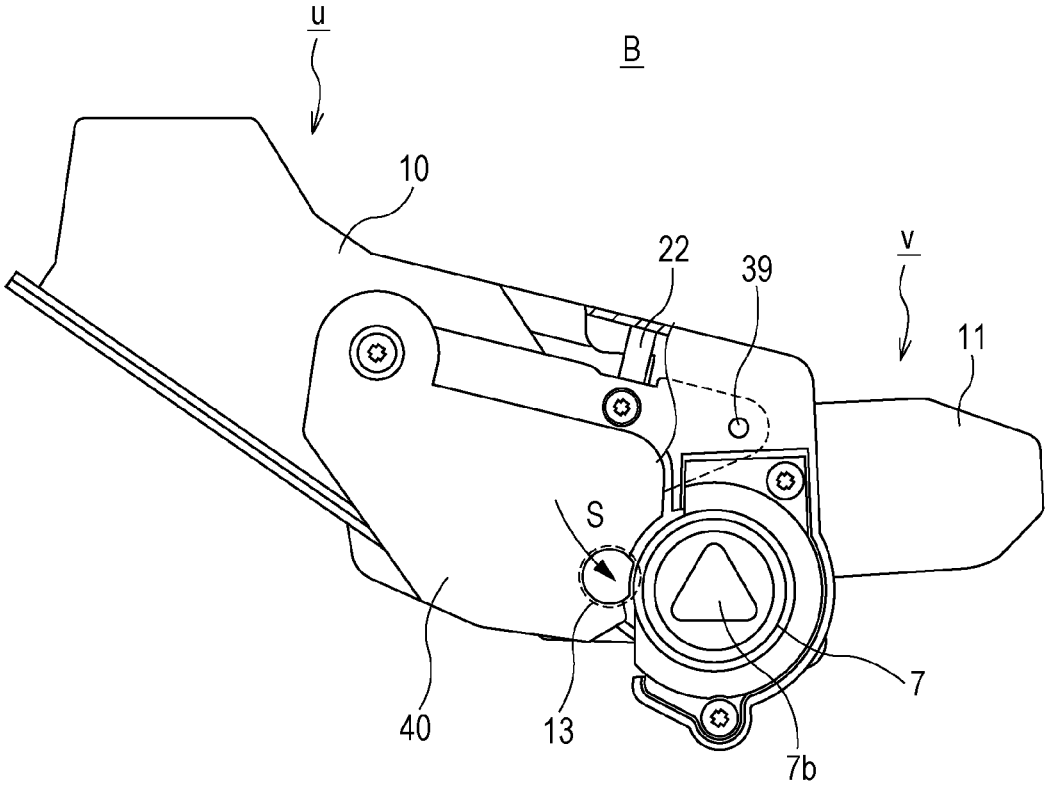
FIG. 25 is a side view at a driving side of the process cartridge according to the seventh embodiment.
Figure 26:
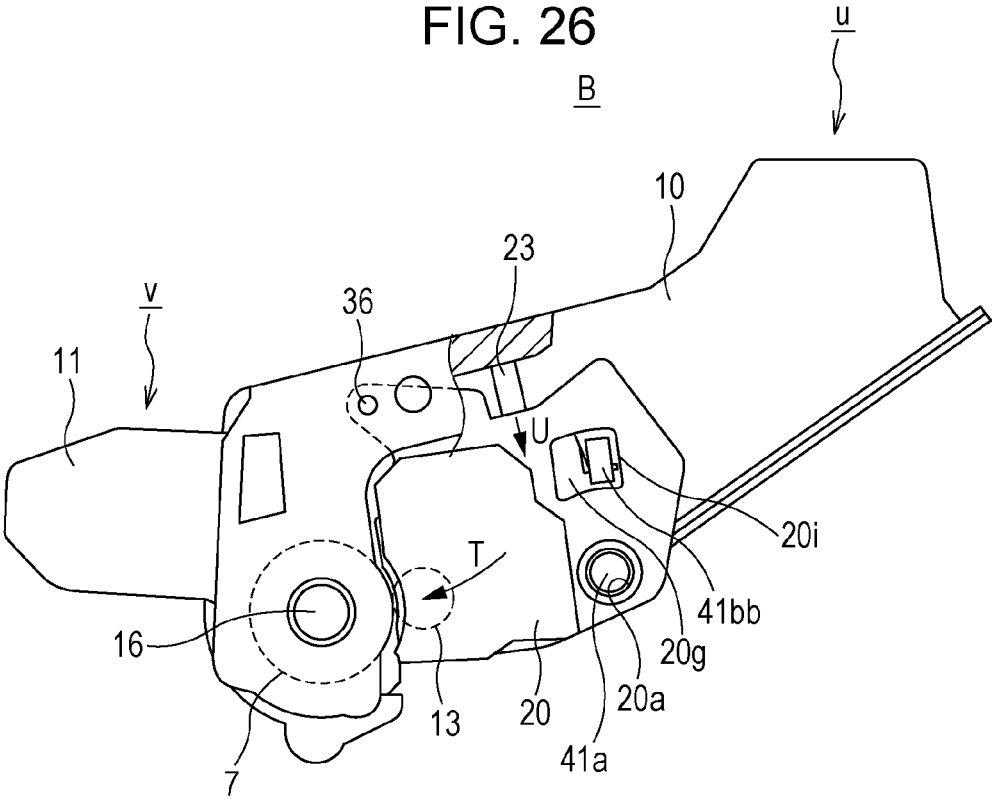
FIG. 26 is a side view at a non-driving side of the process cartridge according to the seventh embodiment.
Figure 27:
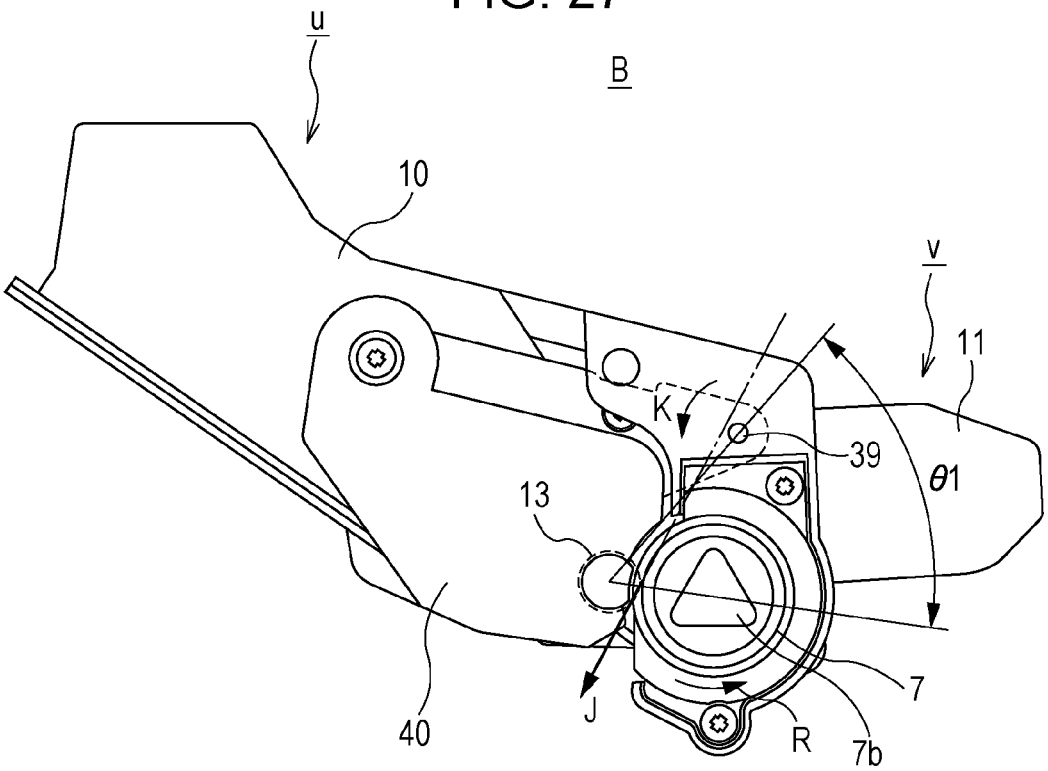
FIG. 27 is a side view at the driving side of the process cartridge according to the seventh embodiment.

Next, a pressure configuration of the developing unit u is described with reference to FIGS. 25 to 28. FIGS. 25 and 27 are side views of the process cartridge B in a view from the driving side. FIGS. 26 and 28 are side views of the process cartridge B in a view from the non-driving side. For the convenience of description, FIGS. 25 and 26 show a state in which part of the frame member (the cleaning frame member 11) of the photosensitive unit u shown in FIGS. 27 and 28 are omitted.

As shown in FIG. 25, a compression spring 22 is arranged between the developing unit u and the photosensitive unit v at the driving side of the process cartridge B. The compression spring 22 comes into contact with the cover member 40 provided at the developing unit u and the cleaning frame member 11 of the photosensitive unit v. The developing unit u is rotated in a direction indicated by arrow S around the coupling pin 39 that is the center of the rotation of the developing unit u by the pressure force of the compression spring 22. Hence, the developing unit u presses the developing roller 13 to the photosensitive drum 7.

In contrast, a compression spring 23 is provided so as to come into contact with the link member 20 and the cleaning frame member 11 of the photosensitive unit v, at the non-driving side shown in FIG. 26. When the compression spring 23 applies a force to the link member 20, a force in a direction indicated by arrow T acts on the link member 20 around the coupling pin 36 that is the center of the rotation. This force is transmitted to the shaft 41*a* of the developing unit u engaging with the link member 20 through the link member 20, so that the developing roller 13 is pressed to the photosensitive drum 7.

The arrangement of the coupling pin 39 that is the center of the rotation of the developing unit u relative to the photosensitive unit v, and the arrangement of the coupling pin 36 that is the center of the rotation of the link member 20 relative to the photosensitive unit v are described with reference to FIGS. 27 and 28.

In FIG. 27, a line, which connects the rotation axis of the photosensitive drum v and the rotation axis of the developing roller 13, and a line, which connects the center of the coupling pin 39 and the rotation axis of the developing roller 13, have an inclination by an angle θ1.

This is because, similarly to the above-described embodiments, the position of the coupling pin 39 is arranged at the opposite side of the rotation axis of the developing roller 13 with respect to the extension line of the gear meshing force J that acts on the developing roller gear 13*a* provided at one end of the developing roller 13. Hence, the gear meshing force J acts on the developing unit u in a direction in which this force causes the developing roller 13 to move toward the photosensitive drum 7 (in a direction indicated by arrow K). Hence, the developing roller 13 does not move away from the photosensitive drum 7 because of the gear meshing force J.

Next, the arrangement of the coupling pin 36 at the non-driving side is described with reference to FIG. 28. Herein, it is assumed that an angle θ2 is defined by a line, which connects the rotation axis of the photosensitive drum 7 and the rotation axis of the developing roller 13, and a line, which connects the center of the coupling pin 36 that is the center of the rotation of the link member 20 relative to the photosensitive unit v and a line connecting the rotation axis of the developing roller 13. In this embodiment, θ2 is determined to be closer to the right angle than θ1. Accordingly, when a force is applied to the developing unit u and the link member 20 in a direction indicated by arrow M2 by the compression spring 23 (see FIG. 26), the force in the direction indicated by arrow M2 can more efficiently work in the direction in which the developing roller 13 is urged to the photosensitive drum 7. It is to be noted that the force in the direction indicated by arrow M2 is a force that causes the link member 20 to rotate around the coupling pin 36.

Next, the arrangement of the fitting portion (the coupling portion) between the link member 20 and the developing unit u according to this embodiment is described. In FIG. 28, it is assumed that F1 is a reactive force acting on the developing roller 13 from the photosensitive drum 7. Herein, the shaft 41*a* and the hole 20*a* serving as the coupling portion of the developing unit u and the link member 20 are located at positions on an extension line of a line L1 connecting the rotation axis of the photosensitive drum 7 and the rotation axis of the developing roller 13. Hence, a phenomenon in which the reactive force F1 causes a moment R1 to act on the developing unit u around the center of the rotation (the center of the shaft 41*a*) can be prevented. In other words, when the reactive force F1 is applied to the developing unit u, the developing unit u is prevented from rotating relative to the link member 20, and the posture of the developing unit u can become stable.

Particularly in this embodiment, design is made such that the extension line of the reactive force F1 passes through the centers of the shaft 41*a* and the hole 20*a*, as the arrangement that makes the posture of the developing unit u the most stable. The above-described effect, however, can be attained as long as the extension line of the reactive force F1 overlaps at least part of the shaft 41*a* and the hole 20*a*. More specifically, the effect can be attained as long as the coupling portion (the hole 20*a*) of the link member 20 with respect to the developing unit u is located at a position on the line passing through the rotation axis of the photosensitive drum 7 and the rotation axis of the developing roller 13 when the process cartridge B is viewed along the longitudinal direction of the process cartridge B.

Also, in FIG. 28, the shaft 41*a* and the hole 20*a* serving as the fitting portion (the coupling portion) of the link member 20 and the developing unit u are arranged near the center of gravity of the developing unit u when the developing unit u is arranged in the posture for image formation. Accordingly, even if the weight of the developing unit u is large, the weight of the developing unit u prevents the phenomenon in which the moment R1 acts on the developing unit u around the center of the rotation (the center of the shaft 41*a*), and can make the posture of the developing unit u stable with respect to the link member 20.

Arrangement of Link Member

Figure 29:
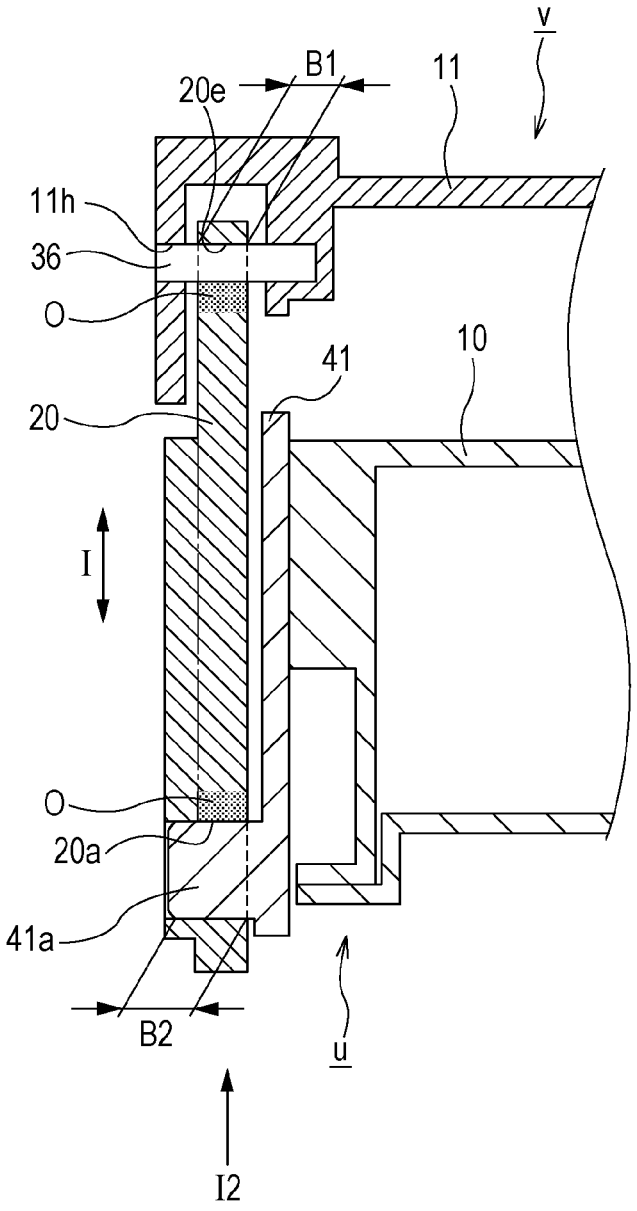
FIG. 29 is a cross-sectional view of a coupling portion of a link member according to the seventh embodiment.

Next, arrangement of the link member in the longitudinal direction of the process cartridge B is described with reference to FIGS. 29 and 30. FIG. 29 is a cross-sectional view of the process cartridge B when the process cartridge B is cut along a line Y connecting the two centers of the rotation of the link member 20 (a line connecting the center of the shaft 41*a* and the center of the coupling pin 36, see FIG. 28).

Herein, a fitting portion B1 between the hole 20*e* of the link member 20 and the coupling pin 36, and a fitting portion B2 between the hole 20*a* of the link member 20 and the shaft 41*a* of the developing unit u are arranged so that an overlap region O in the longitudinal direction is present. In particular, as shown in FIG. 29, a region where the link member 20 is coupled with the photosensitive unit v (the fitting portion B1) and a region where the link member 20 is coupled with the developing unit u (the fitting portion B2) overlap each other in the region O when viewed along a direction indicated by arrow I2 that is orthogonal to the longitudinal direction.

Accordingly, even if the link member 20 is pulled by the two fitting portions B1 and B2 and a force I in a direction orthogonal to the longitudinal direction of the process cartridge B is applied to the link member 20, the link member 20 can be prevented from being inclined with respect to the developing unit u and the photosensitive unit.

Figure 30:
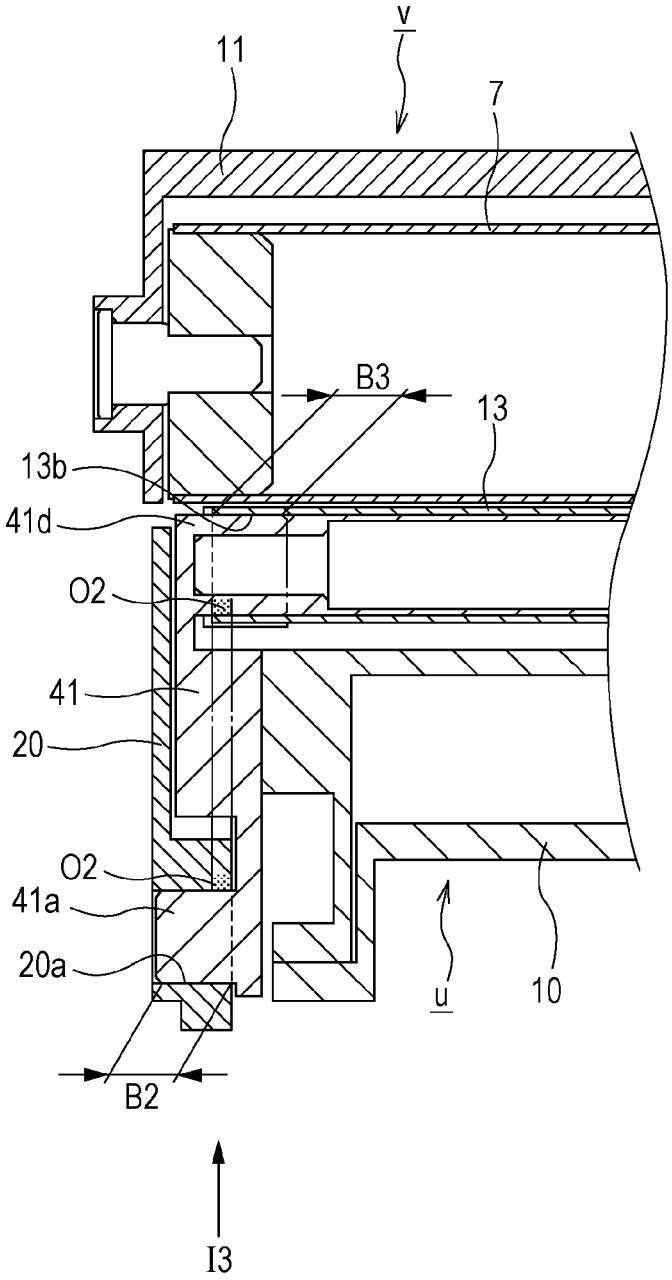
FIG. 30 is a cross-sectional view of the coupling portion of the link member according to the seventh embodiment.

FIG. 30 is a cross-sectional view of the process cartridge B when the process cartridge B is cut along the line L1 (see FIG. 28) connecting the center of the hole 20*a* of the link member 20 and the center of the rotation shaft of the developing roller 13. The bearing member 41 has a shaft 41*d* that is fitted to the developing roller 13. The developing roller 13 has a hole 13*b* that is fitted to the shaft 41*d*. A fitting portion B3 between the shaft 41*d* and the hole 13*b*, and the fitting portion B2 between the hole 20*a* of the link member 20 and the shaft 41*a* of the developing unit u are arranged such that an overlap region O2 in the longitudinal direction is present.

In particular, the supported portion (the fitting portion B3) of the developing roller 13 supported by the frame member (the bearing member 41) of the developing unit u, and the region (B2) where the developing unit u is coupled with the link member 20 at least partly overlap each other when viewed along a direction indicated by arrow I3 orthogonal to the longitudinal direction.

Accordingly, the fitting portion of the link member 20 with respect to the developing unit u does not protrude to the outside in the longitudinal direction with respect to the support portion of the developing roller 13. Thus, the process cartridge B can be downsized in the longitudinal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-135098 filed Jun. 17, 2011 and No. 2012-106922 filed May 8, 2012, which are hereby incorporated by reference herein in their entirety.

What is claimed is:

1. A process cartridge configured to be removably mounted on an apparatus body of an electrophotographic image forming apparatus, comprising:

a photosensitive unit including a photosensitive drum;

a developing unit including a developing roller configured to develop an electrostatic latent image formed on the photosensitive drum, and configured to be rotatably coupled with the photosensitive unit around only a single center of rotation at one end side of the process cartridge in an axial direction of the photosensitive drum;

a link member provided at the other end side of the process cartridge in the axial direction;

a first shaft portion that couples the link member with the photosensitive unit;

a second shaft portion that couples the link member with the developing unit; and wherein the link member rotates around the first shaft portion with respect to the photosensitive unit, wherein the link member rotates around the second shaft portion with respect to the developing unit, and wherein the link member allows relative movement between the developing roller and the photosensitive drum at the other end side of the process cartridge.

2. The process cartridge according to claim 1, further comprising a rotation restricting unit configured to restrict a range of rotation of the developing unit relative to the link member.

3. The process cartridge according to claim 2, wherein the rotation restricting unit includes a restricting portion provided proximate the link member and a restricted portion provided proximate the developing unit, and restricts rotation of the developing unit such that the restricting portion contacts the restricted portion if the developing unit rotates relative to the link member by an angle exceeding a predetermined angle.

4. The process cartridge according to claim 1, further comprising a movement restricting portion provided proximate one of the link member and the developing unit, and configured to restrict movement of the link member to the outside in the axial direction such that the movement restricting portion comes into contact with the other of the link member and the developing unit.

5. The process cartridge according to claim 3, wherein at least one of the restricting portion and the restricted portion also functions as a movement restricting portion configured to restrict movement of the link member to the outside in the axial direction.

6. The process cartridge according to claim 3, wherein the restricting portion is integrally formed on the first shaft portion.

7. The process cartridge according to claim 1, further comprising a first urging member configured to urge the developing roller to the photosensitive drum such that the first urging member contacts the photosensitive unit and the link member.

8. The process cartridge according to claim 1, wherein a coupled portion of the photosensitive unit, coupled with the link member, and a coupled portion of the developing unit, coupled with the link member, are not rotationally driven when the electrophotographic image forming apparatus forms an image.

9. The process cartridge according to claim 8, wherein the photosensitive unit includes a first frame member configured to rotatably support both ends of the photosensitive drum, wherein the developing unit includes a second frame member configured to rotatably support both ends of the developing roller, and wherein the link member is coupled with the first frame member and the second frame member.

10. The process cartridge according to claim 1, wherein a region where the link member is coupled with the photosensitive unit and a region where the link member is coupled with the developing unit at least partly overlap each other when viewed along a direction orthogonal to the axial direction of the photosensitive drum.

11. The process cartridge according to claim 1, wherein a region where the link member is coupled with the developing unit and a region where the developing roller is supported in the developing unit at least partly overlap each other when viewed along a direction orthogonal to the axial direction of the photosensitive drum.

12. The process cartridge according to claim 1, wherein the second shaft portion is located on an extension line of a line extending from an axis of the photosensitive drum to an axis of the developing roller when viewed along the axial direction of the photosensitive drum.

13. The process cartridge according to claim 1, further comprising:

a first gear arranged proximate the photosensitive drum at the one end side; and a second gear arranged proximate the developing roller at the one end side, and configured to transmit a driving force from the photosensitive drum to the developing roller such that the second gear meshes with the first gear.

14. The process cartridge according to claim 13, wherein a center of the rotation of the developing unit relative to the photosensitive unit at the one end side is arranged at a side at which an axis of the developing roller is not located, with respect to a line extending in a direction of a force that is generated because the first gear meshes with the second gear when viewed along the axial direction of the photosensitive drum when the developing roller and the photosensitive drum rotate.

15. The process cartridge according to claim 1, wherein $\theta 2$ is closer to a right angle than $\theta 1$, where, when viewed along the axial direction of the photosensitive drum, a first line is a line passing through an axis of the developing roller and an axis of the photosensitive drum, a second line is a line passing through the center of the rotation of the developing unit relative to the photosensitive unit at the one end side and the axis of the developing roller, and a third line is a line passing through a center of rotation of the link member relative to the photosensitive unit and the axis of the developing roller, and where $\theta 1$ is an angle defined by the first line and the second line, and $\theta 2$ is an angle defined by the first line and the third line in the view.

16. The process cartridge according to claim 1, wherein, when viewed along the axial direction of the photosensitive drum, at least a center of rotation of the link member relative to the photosensitive unit is not coaxial with a rotation axis of the photosensitive drum, or the center of the rotation of the link member relative to the developing unit is not coaxial with an axis of the developing roller.

17. The process cartridge according to claim 1, further comprising a gap retaining member provided at the developing roller and configured to contact the photosensitive drum and provide a gap between a surface of the developing roller and a surface of the photosensitive drum.

18. The process cartridge according to claim 1, wherein the developing roller is formed of an elastic member, and wherein the process cartridge further comprises a deformation-amount regulating member provided at the developing roller, configured to contact the photosensitive drum, and configured to regulate a deformation amount the developing roller is deformed when the developing roller contacts the photosensitive drum.

19. The process cartridge according to claim 1, further comprising:

an urging member configured to urge the developing roller to the photosensitive drum, wherein the developing roller and the photosensitive drum are located on a line extending in a direction in which the urging member applies a force when viewed along the axial direction of the photosensitive drum.

20. The process cartridge according to claim 1, wherein, when viewed along the axial direction of the photosensitive drum, a distance between a center of rotation of the link member relative to the photosensitive unit and an axis of the developing roller is smaller than a distance between the center of the rotation of the developing unit relative to the photosensitive unit and the axis of the developing roller at the one side.

21. An electrophotographic image forming apparatus configured to form an image on a recording medium, comprising:

(i) a process cartridge configured to be removably mounted on an apparatus body of an electrophotographic image forming apparatus and including a photosensitive unit including a photosensitive drum, a developing unit including a developing roller configured to develop an electrostatic latent image formed on the photosensitive drum, and configured to be rotatably coupled with the photosensitive unit around only a single center of rotation at one end side of the process cartridge in an axial direction of the photosensitive drum, and a link member provided at the other end side of the process cartridge in the axial direction; and (ii) a conveying unit configured to convey the recording medium, wherein the link member allows relative movement between the developing roller and the photosensitive drum at the other end side of the process cartridge, the process cartridge, comprising:

a first shaft portion that couples the link member with the photosensitive unit; and a second shaft portion that couples the link member with the developing unit;

wherein the link member rotates around the first shaft portion with respect to the photosensitive unit, and wherein the link member rotates around the second shaft portion with respect to the developing unit.

22. The electrophotographic image forming apparatus according to claim 21, wherein the process cartridge includes a rotation restricting unit configured to restrict a range of the rotation of the developing unit relative to the link member.

23. The electrophotographic image forming apparatus according to claim 22, wherein the rotation restricting unit includes a restricting portion arranged proximate the link member and a restricted portion arranged proximate the developing unit, and restricts the rotation of the developing unit such that the restricting portion contacts the restricted portion if the developing unit rotates relative to the link member by an angle exceeding a predetermined angle.

24. The electrophotographic image forming apparatus according to claim 21, further comprising a movement restricting portion provided proximate one of the link member and the developing unit, and configured to restrict movement of the link member to the outside in the axial direction such that the movement restricting portion contacts the other of the link member and the developing unit.

25. The electrophotographic image forming apparatus according to claim 23, wherein at least one of the restricting portion and the restricted portion also serves as a movement restricting portion configured to restrict movement of the link member to the outside in the axial direction.

26. The electrophotographic image forming apparatus according to claim 21, further comprising a body urging member provided at the apparatus body, and configured to contact the process cartridge and urge the developing roller to the photosensitive drum.

27. The electrophotographic image forming apparatus according to claim 26, wherein the developing roller and the photosensitive drum are located on a line extending in a direction in which the body urging member applies a force when viewed along the axial direction of the photosensitive drum.

28. An assembly method of a process cartridge including a photosensitive unit having a photosensitive drum on which an electrostatic latent image is formed, and a developing unit having a developing roller configured to support a developer for developing the electrostatic latent image, the method comprising:

attaching a link member to one end side of the developing unit in an axial direction of the developing roller;

attaching the link member to one end side of the photosensitive unit in an axial direction of the photosensitive drum; and coupling the other end side of the developing unit in the axial direction of the developing roller with the other end side of the photosensitive unit in the axial direction of the photosensitive drum rotatably around only a single center of rotation, wherein, when attaching the link member to the photosensitive unit, the link member is made to be rotatable around a first shaft portion with respect to the photosensitive unit by coupling the link member with the photosensitive unit, with the first shaft portion, and wherein, when attaching the link member to the developing unit, the link member is made to be rotatable around a second shaft portion with respect to the developing unit by engaging the link member with the developing unit, with the second shaft portion.

29. The assembly method of the process cartridge according to claim 28, further comprising:

after the link member is attached to the developing unit, attaching the link member to the photosensitive unit; and coupling the developing unit with the photosensitive unit.

30. The assembly method of the process cartridge according to claim 28, wherein the link member includes a movement restricting portion configured to restrict movement of the link member to the outside in the axial direction of the developing roller relative to the developing unit, and wherein after the link member is attached to the developing unit, the link member is rotated to a position at which the movement restricting portion functions.

31. The assembly method of the process cartridge according to claim 30, wherein the link member further includes a rotation restricting portion that restricts a range of the rotation of the link member relative to the developing unit, and wherein after the link member is attached to the developing unit, the link member is rotated to a position at which the movement restricting portion and the rotation restricting portion function by a weight of the link member.

* * * * *